United States Patent [19]

Hess et al.

[11] 3,947,947

[45] Apr. 6, 1976

[54] CONDUIT MAKING MACHINE, AND METHOD OF MAKING AN ARTICLE MADE THEREBY

[75] Inventors: James R. Hess, Bethel; Lester M. Burkholder, Bernville; Richard L. Rettew, Newmanstown, all of Pa.

[73] Assignee: Penn Berks Corporation, Bethel, Pa.

[22] Filed: May 17, 1973

[21] Appl. No.: 361,145

Related U.S. Application Data

[63] Continuation-in-part of Ser. No. 83,419, Oct. 23, 1970, abandoned.

[52] U.S. Cl. ..... 29/411; 29/33 K; 29/200 B; 29/417; 29/429; 29/453; 29/513; 113/1 N; 138/162

[51] Int. Cl.[2] ..... B23P 17/00

[58] Field of Search ..... 29/411, 33.9, 429, 417, 29/509, 453, 513, 463, 155, 200 B, 521; 113/1 N; 138/162

[56] References Cited

UNITED STATES PATENTS

| | | | |
|---|---|---|---|
| 2,127,618 | 8/1938 | Riemenschneider | 29/417 |
| 2,411,011 | 11/1946 | Troiel | 138/162 |
| 2,840,897 | 7/1958 | Ingalls | 29/463 |
| 3,038,759 | 6/1962 | Tilgner | 29/429 UX |
| 3,249,023 | 5/1966 | Toby | 29/453 X |
| 3,296,674 | 1/1967 | Meshulam | 29/513 X |
| 3,410,349 | 11/1968 | Troutman | 29/513 X |
| 3,420,032 | 1/1969 | Felt | 29/155 R X |

*Primary Examiner*—Charlie T. Moon
*Attorney, Agent, or Firm*—Paul & Paul

[57] ABSTRACT

A machine is provided, for continuously making drainage conduit of two pieces, with various mechanisms for performing forming, punching, joining, sawing and ejecting functions, as material is carried through the machine.

52 Claims, 30 Drawing Figures

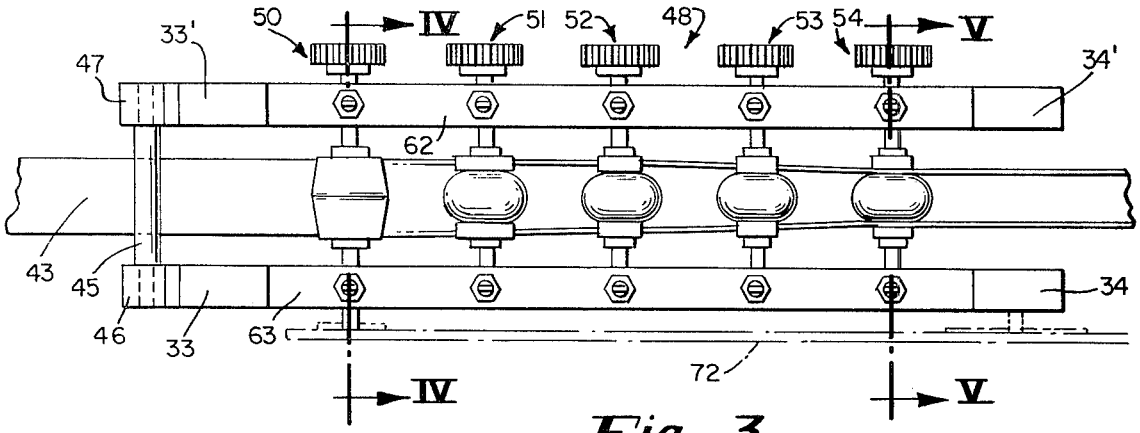
Fig. 3
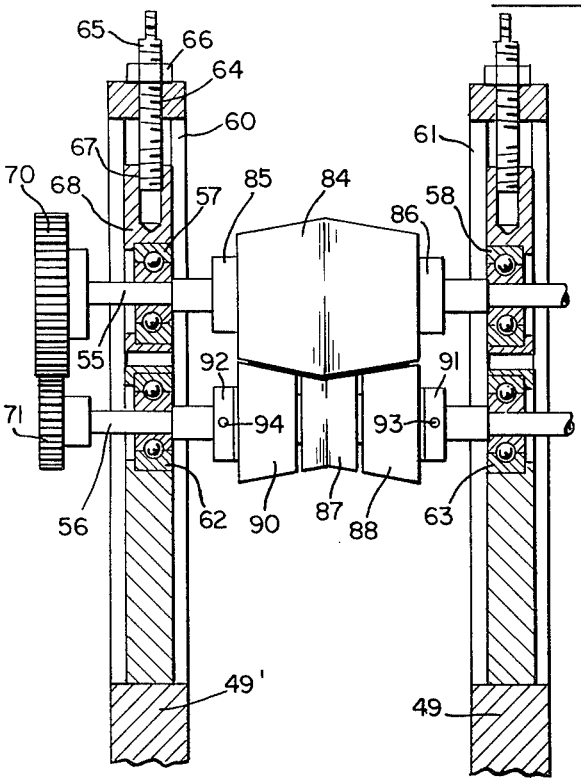
Fig. 4
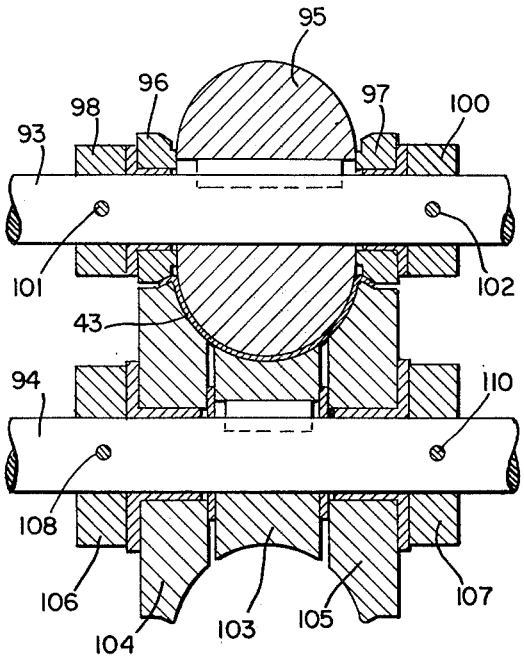
Fig. 5
Fig. 6
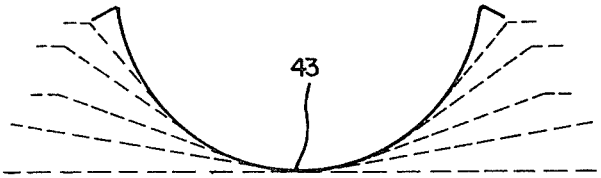

Fig. 10
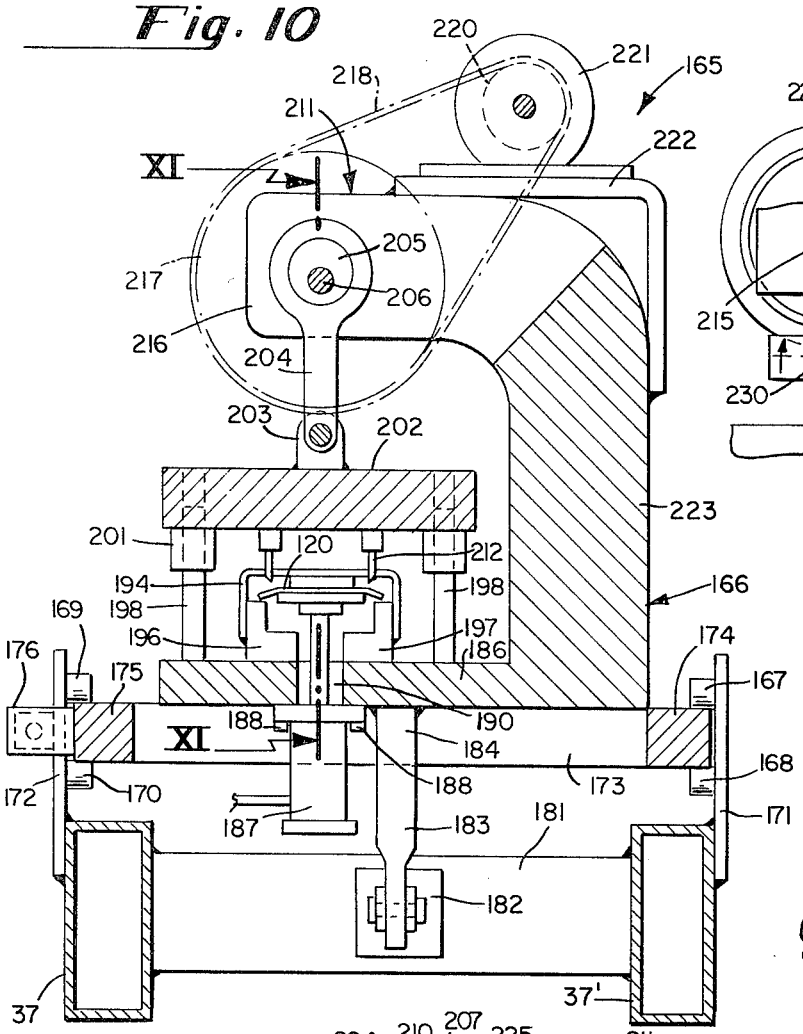
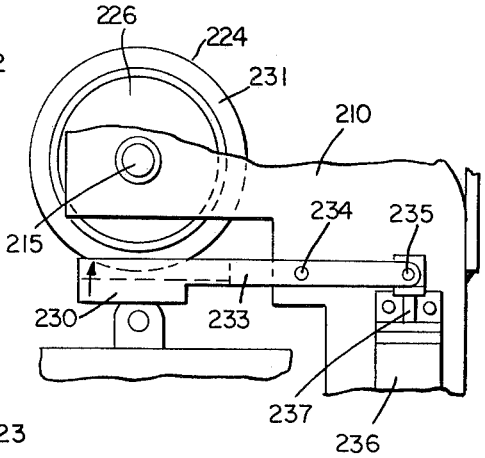
Fig. 12
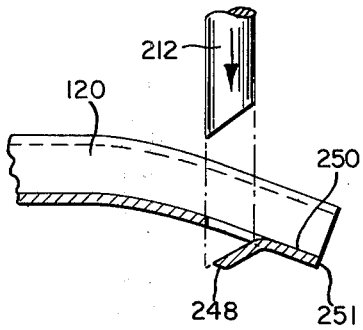
Fig. 13
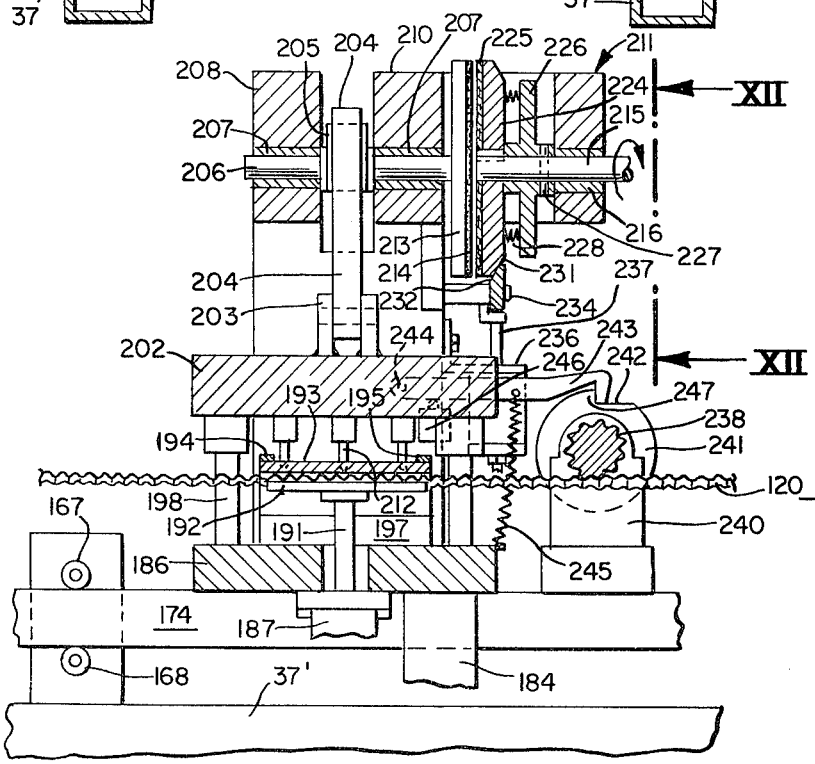
Fig. 11

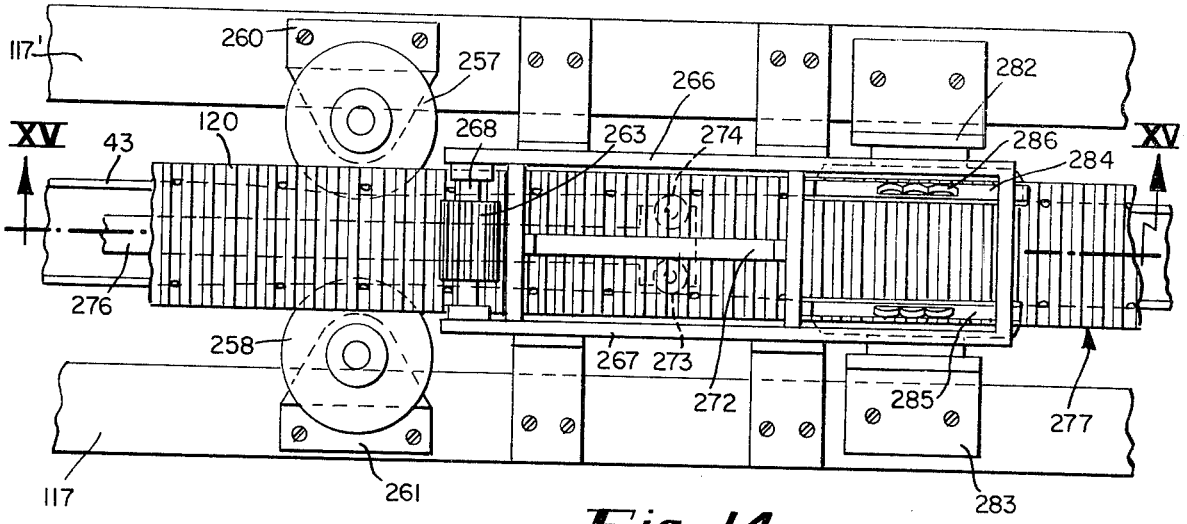
Fig. 14
Fig. 15
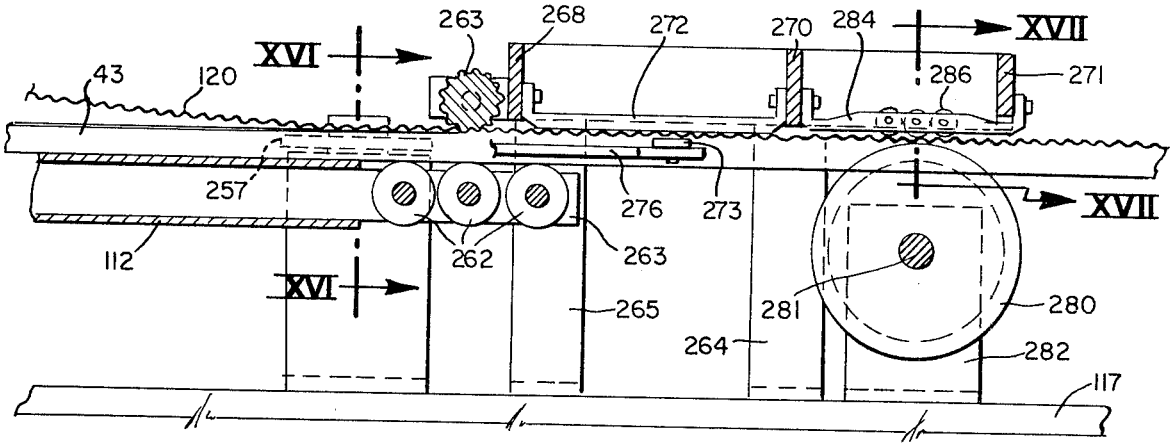
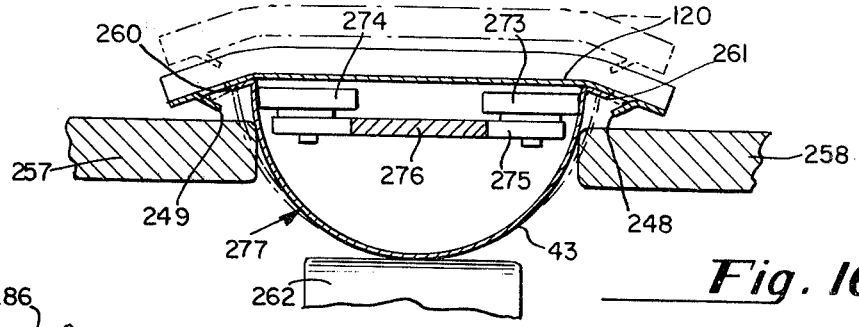
Fig. 16
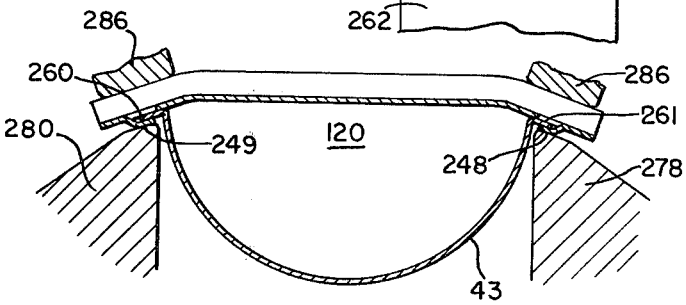
Fig. 17

Fig. 18
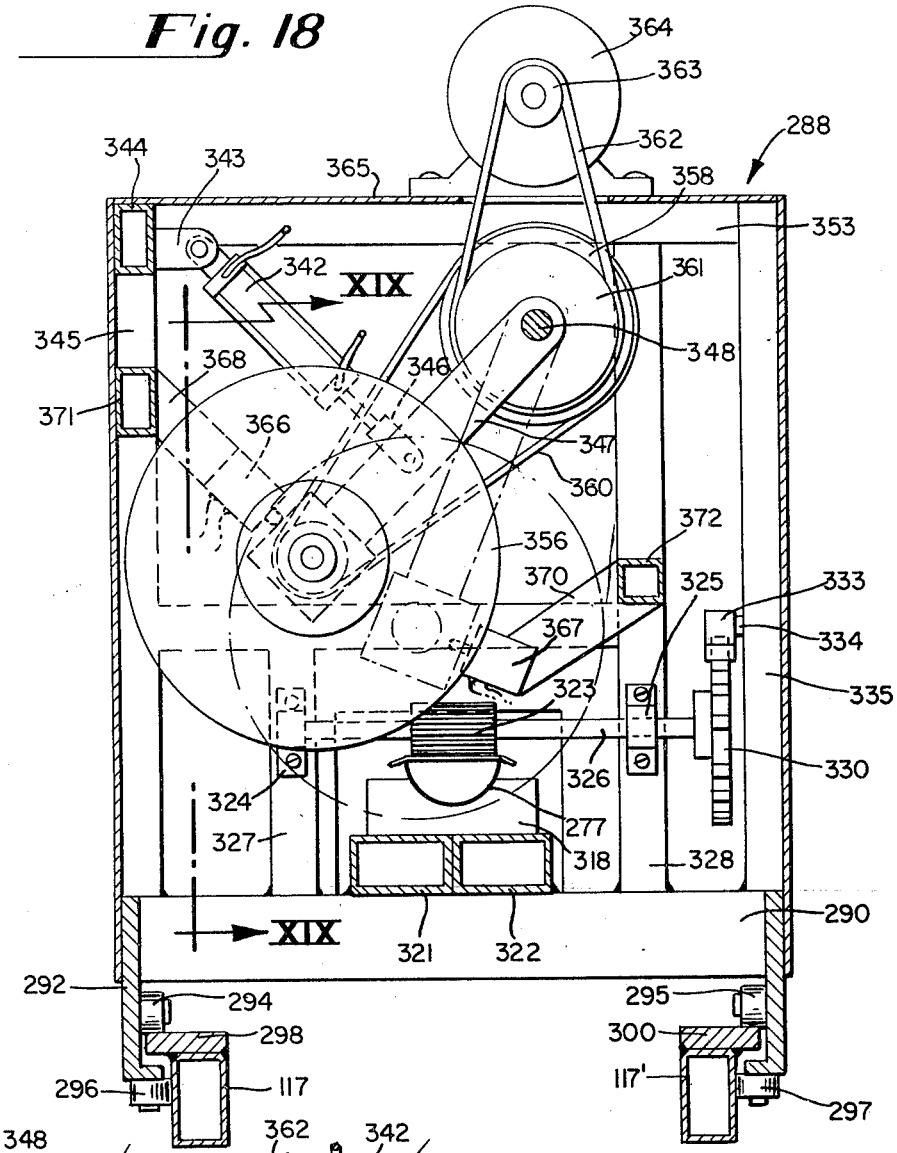
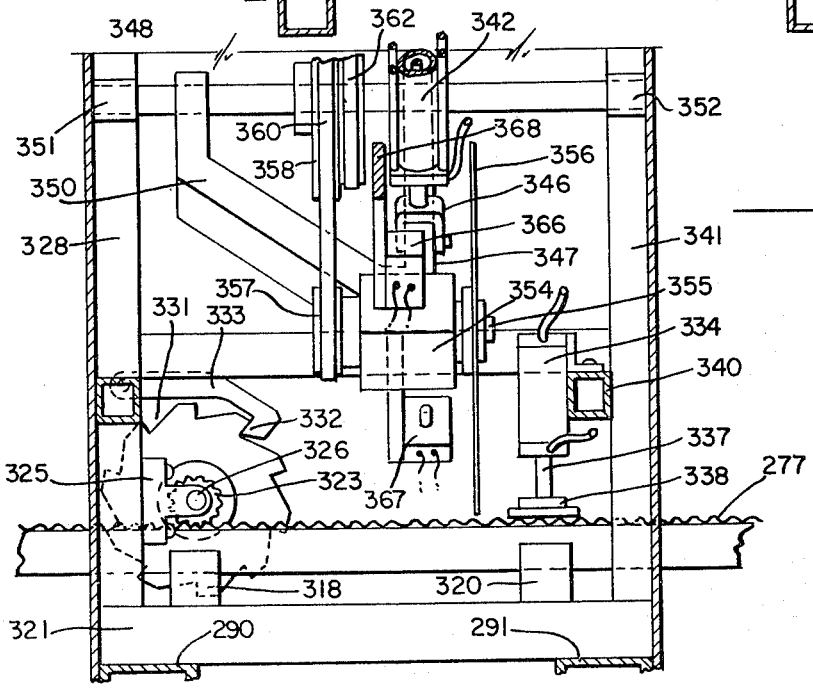
Fig. 19

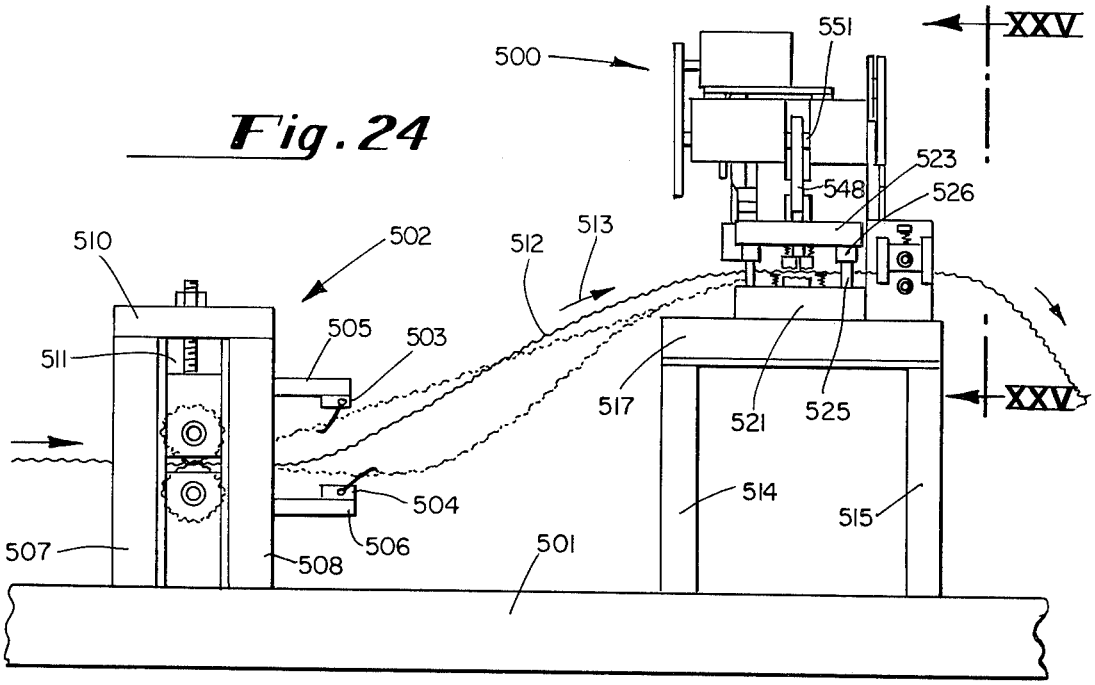
Fig. 24
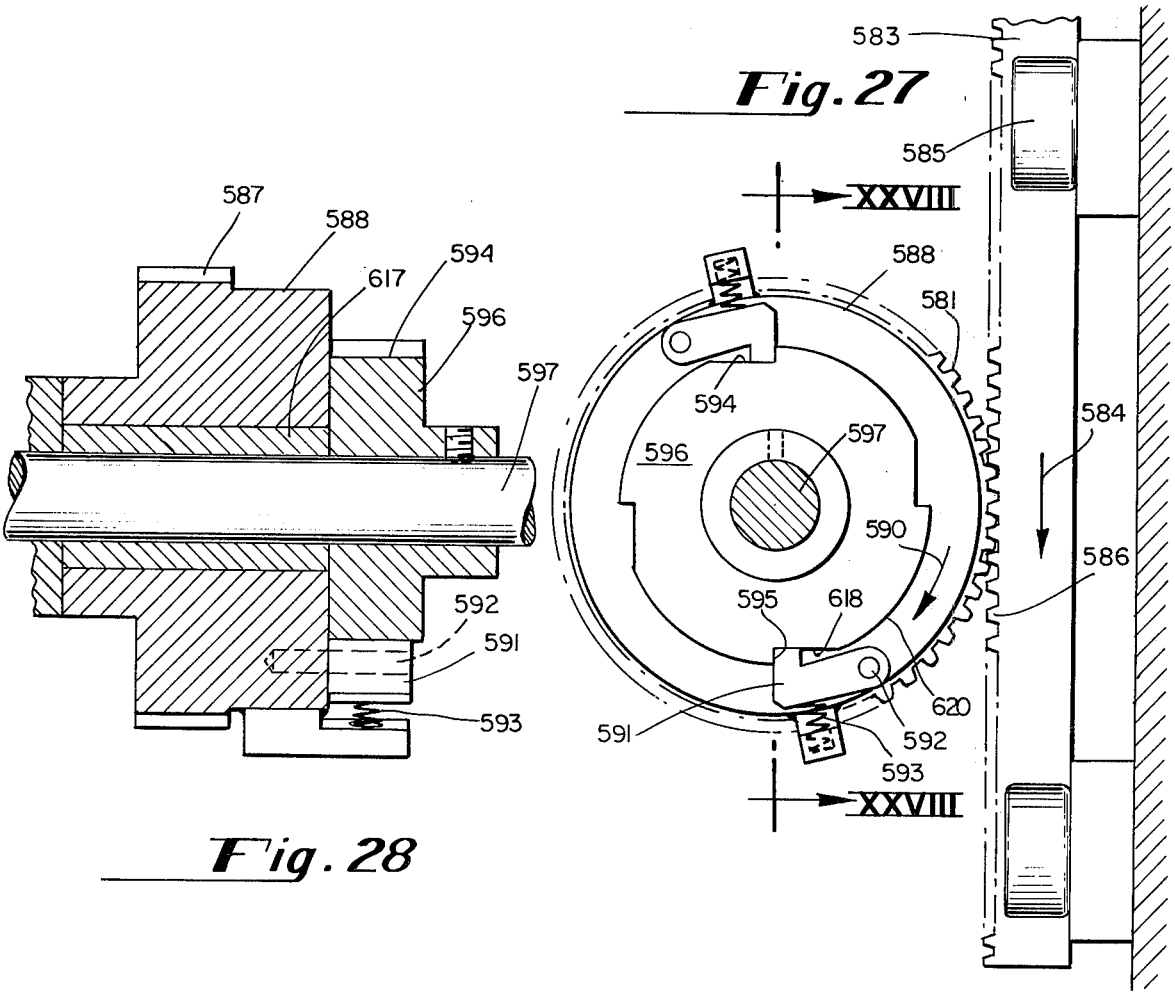
Fig. 27
Fig. 28

Fig. 30
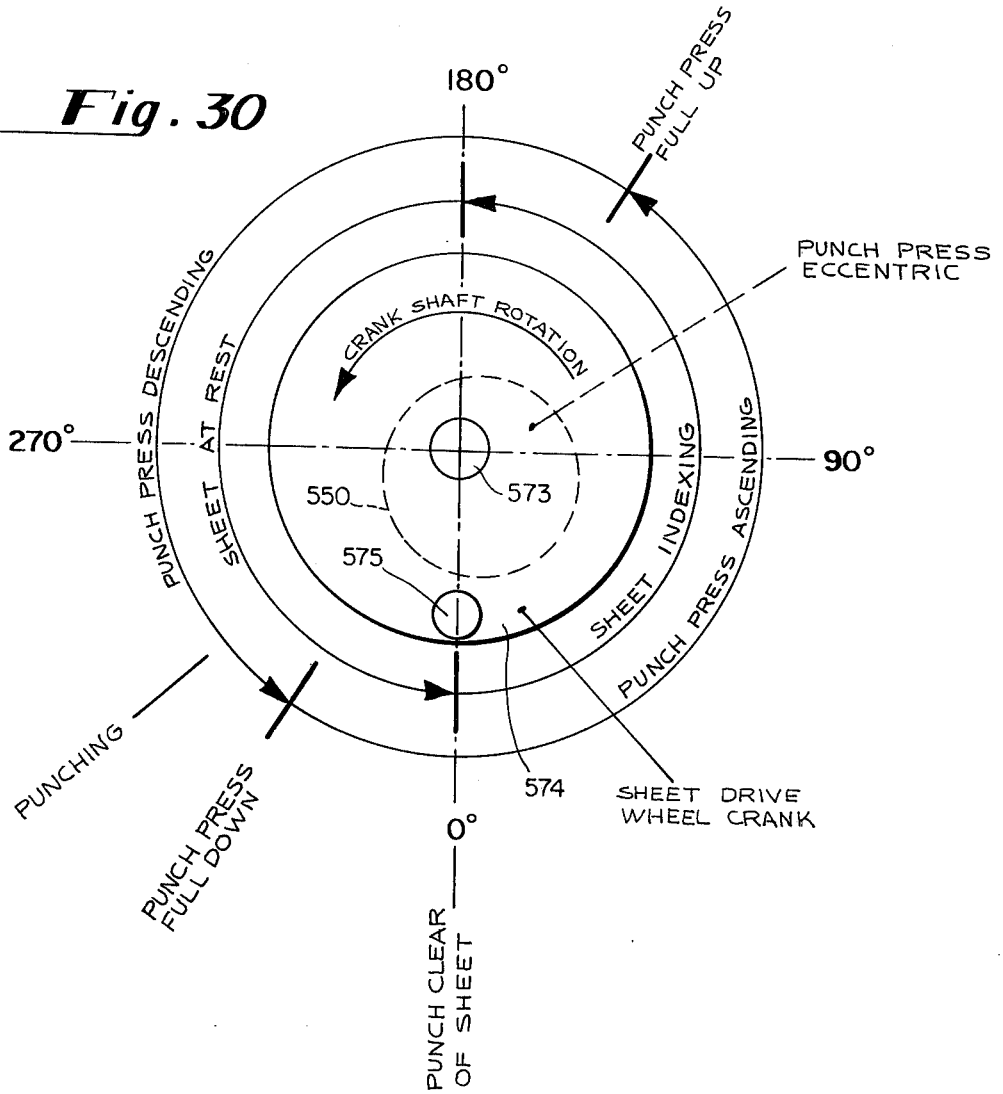
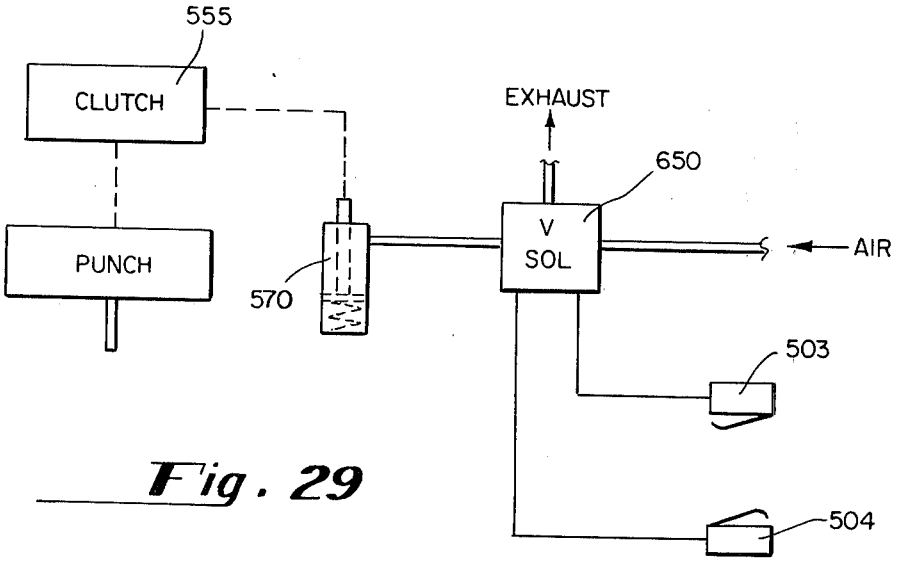
Fig. 29

CONDUIT MAKING MACHINE, AND METHOD OF MAKING AN ARTICLE MADE THEREBY

CROSS-REFERENCE TO RELATED APPLICATION

This is a continuation-in-part of co-pending application Ser. No. 83,419, Filed Oct. 23, 1970, now abandoned.

BACKGROUND OF THE INVENTION

In the past, drainage lines for water and the like have become recognized as being virtually essential alongside roadways, beneath the roadways, for carrying off water from a level beneath the road that may otherwise tend to rise to the level of the road and flood the same.

Generally, such water conduits have been placed at the sides of roads, a few feet below the road, imbedded in gravel or in like loose stone fill that will permit seepage of water to the conduit.

Previously, the conduit comprised a plurality of sections of round spiral corrugated pipe, placed end-to-end. These pipe connections would generally be 6 inches to 8 inches in diameter, in order to carry off the desired flow of water. However, the corrugations on the inside surface of the pipe, over which water would flow, would induce turbulence that would interfere with the streamline flow of water through the pipe. Furthermore, water inlets to such pipe would clog with dirt if they were in the upper half circle of the pipe and if the pipe were positioned such that the water inlets were in the lower half circle of the pipe, the zone of the pipe through which water could be carried was severly limited.

Accordingly, there has been a tendency away from the use of such pipe as drainage conduit, and toward the use of conduit that may be fabricated to have smooth interior surfaces, for more greatly facilitating the free passage of water therealong. Because of the usual smooth surface present in making metal drainage conduit, and the ability of steel to pass water freely therealong, a drainage conduit having a smooth inner bottom surface may be greatly reduced in size, relative to a corrugated drainage conduit, for handling virtually the same flow of water. For example, whereas, with the use of round corrugated drainage conduit, a 6 inch to 8 inch diameter line may be required, a semi-circular conduit with a smooth inner bottom surface may be, for example, 4⅝ inches across, and yet may handle the same flow of water.

The use of steel or other metal conduit has been highly desirable, but, in the manufacture of the same, in accordance with manufacturing techniques that require many hand working operations, the use of metal drainage conduit has not reached its potential due to high labor costs for hand operations, limitations upon production speeds, and the like.

SUMMARY OF THE INVENTION

In accordance with the present invention, the problems set forth above, and others are obviated, with the development of a machine for continuously making drainage conduit of two pieces of material that are provided in a continuous manner, with the various forming, joining, connecting, cutting and ejecting operations being effected in a generally continuous manner, without interruption of the continuous manufacture of the conduit construction, although a given operation, such as the punching operation may be done with intermittent motion of the sheet being punched through the punching mechanism, without disturbing the overall movement of that mechanism through the overall machine of this invention.

Accordingly, it is a primary object of this invention to provide a novel machine for continuously making drainage conduit.

It is a further object of this invention to provide a novel machine for making conduit from two elongated pieces of material, as the material continuously moves through the machine, with the material being appropriately formed, joined and cut to length during such movement through the machine.

It is another obejct of this invention to provide a novel machine for making conduit from two elongated pieces of material, as the material continuously moves through the machine, with any discontinuous operation being localized only, and not interrupting the general flow of material through the machine.

It is another object of the present invention to provide a machine that will make conduit having an arcuate bottom and a corrugated top, with a desired configuration, wherein the bottom and the top may be connected without the use of additional components, by the use of connecting tabs or the like integral with one of the pieces, and with the conduit being cut to desired selected lengths.

Further objects of the present invention include the use of novel punching mechanisms, forming mechanisms, joining, sawing mechanisms and ejecting mechanisms, each adapted for use by itself, and each adapted for use in conjunction with one of more such mechanisms, as components of a machine for continuously making conduit.

A further object of the present invention is the provision of novel manufacturing techniques and methods of making conduit, in accordance with the hereinafter disclosed invention.

Other objects and advantages of the present invention will be readily apparent to those skilled in the art from a reading of the following brief descriptions of the drawing figures, detailed description of the preferred embodiments, and the appended claims. In the drawings:

FIGS. 1 and 2, taken together, constitute a side elevational view of the entire machine of this invention.

FIG. 3 is a top view, taken generally along the line III—III of FIG. 1, wherein the various rolls for progressively forming the arcuate bottom piece for the conduit of this invention are clearly illustrated in plan view.

FIG. 4 is an enlarged transverse sectional view, taken generally along the line IV—IV of FIG. 3, and wherein one such roller and drive means therefor are more clearly illustrated.

FIG. 5 is an enlarged transverse cross-sectional view, taken through another roll forming stage of this invention, generally along the line V—V of FIG. 3, and wherein the driven roller portions and idler roller portions are more clearly illustrated in detailed sectional view.

FIG. 6 is a composite schematic view illustrating various stages of formation of the bottom conduit piece of this invention, as schematic illustrations. The various stages illustrated are those starting with the flat sheet (illustrated in phantom), and continuing through four different progressively more acruately configured stages (illustrated in phantom), to the final stage of formation, whereby the bottom conduit piece is completely formed (illustrated in full lines).

Figure 1:
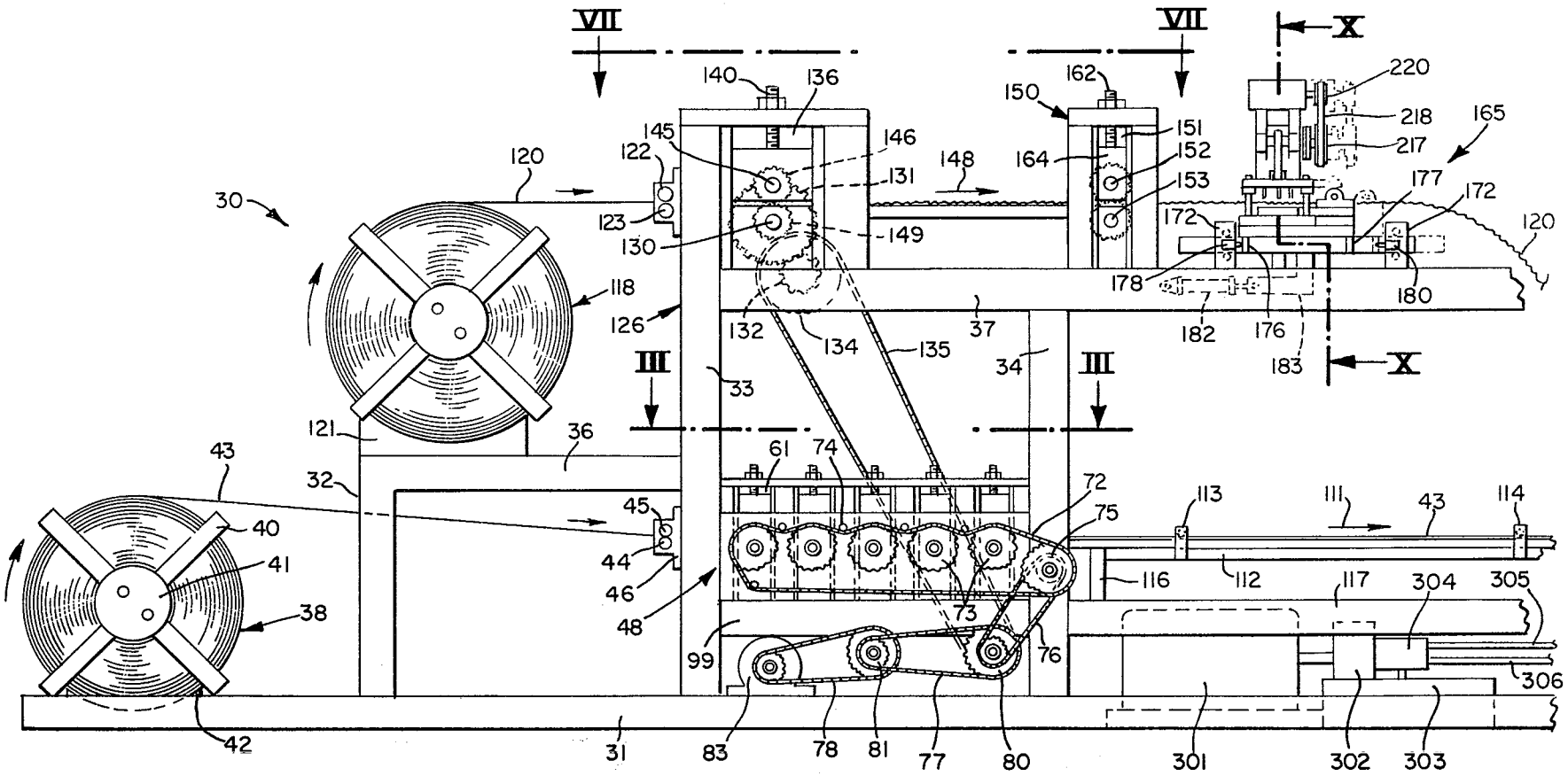
FIG. 1 is a side elevational view of a portion of the machine of this invention.
Figure 7:
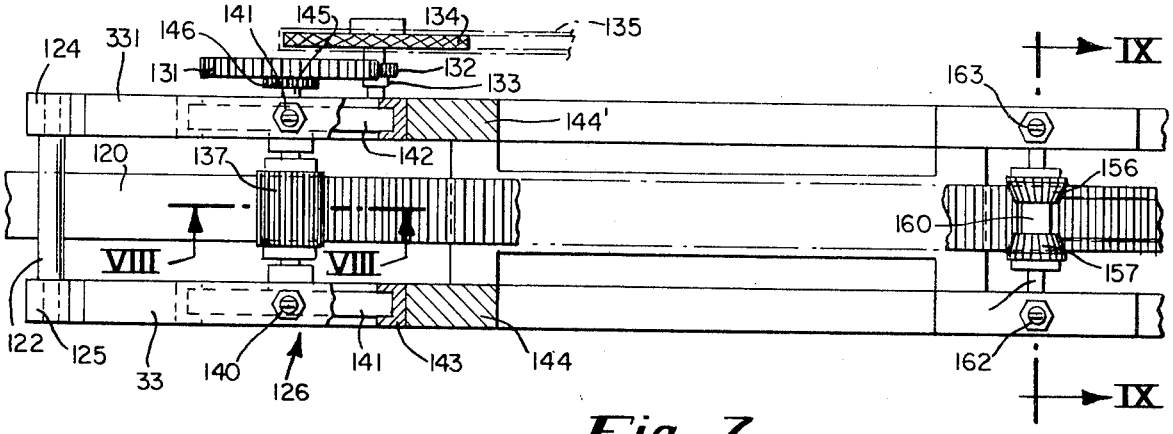

FIG. 7 is a top plan view of a portion of the machine of this invention, taken generally along the lines VII—VII of FIG. 1, with portions shown in section, for illustrating the portion of the machine which performs the corrugating function on the top conduit piece, or cover member, as well as for illustrating that portion of the machine which bends downwardly edges of the top piece.

Figure 8:
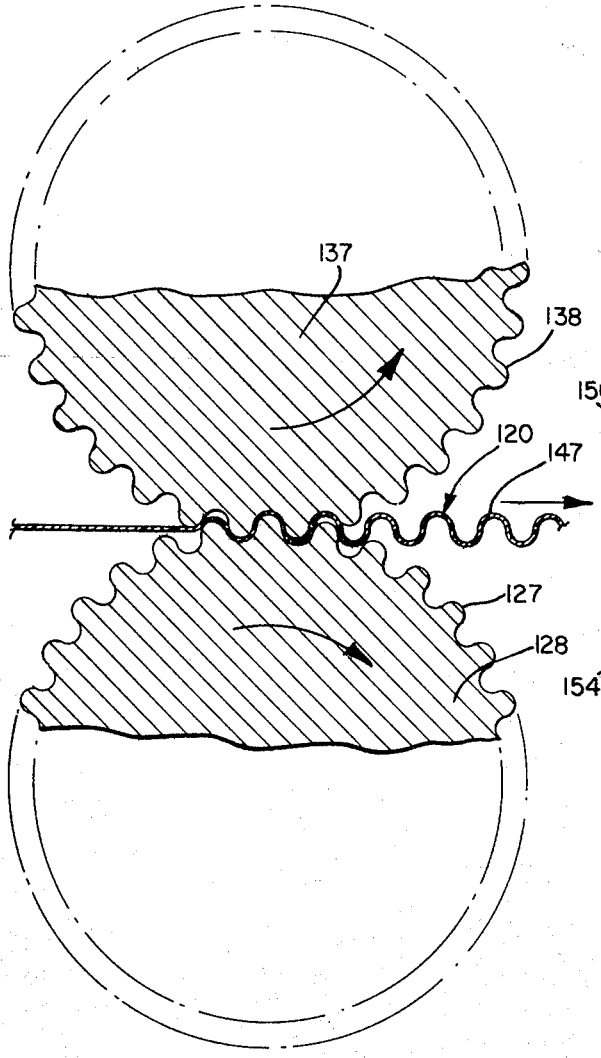

FIG. 8 is an enlarged transverse sectional view taken through the upper and lower corugating rolls of this invention, generally along the line VIII—VIII of FIG. 7, and wherein the manner in which the rolls corrugate the upper piece is clearly illustrated.

Figure 9:
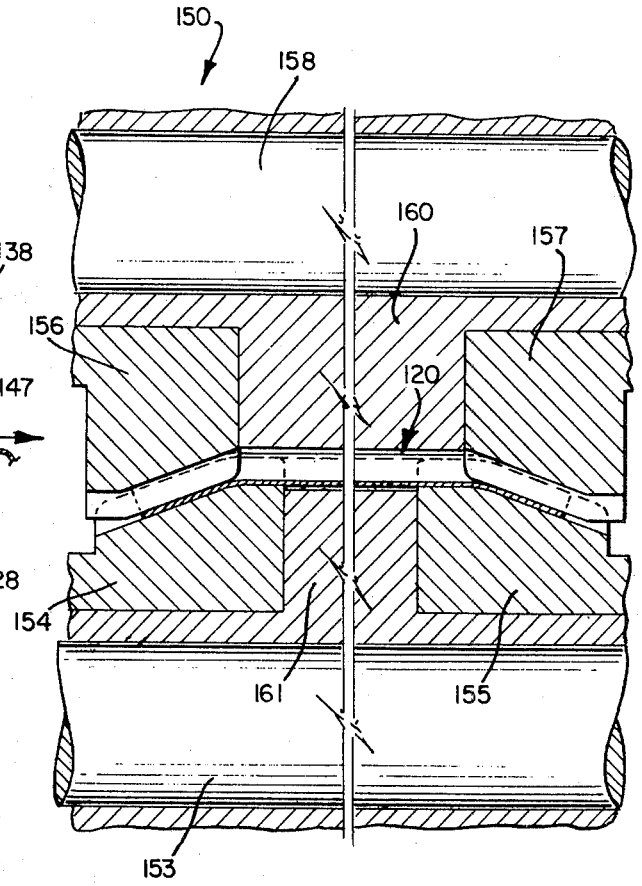

FIG. 9 is an enlarged fragmentary cross-sectional view, taken generally along the line IX—IX of FIG. 7, and wherein the device for bending down the edges of the top corrugated piece is more clearly illustrated.

FIG. 10 is an enlarged transverse sectional view, taken through the punching mechanism of this invention, generally along the line X—X of FIG. 1, and wherein the punching apparatus is clearly illustrated.

FIG. 11 is a longitudinal sectional view taken through the punching apparatus of this invention, generally along the line XI—XI of FIG. 10, and wherein the various mechhanisms for effecting downward movement of the punching elements are more clearly illustrated.

FIG. 12 is a slightly enlarged fragmentary view of a portion of the clutch actuating structure illustrated in FIG. 11, taken generally along the line XII—XII of FIG. 11.

FIG. 13 is an enlarged fragmentary detail view, partially in section, illustrating the manner in which a single punching element effects the punching of a tab from a downwardly bent edge portion of a corrugated upper conduit piece.

FIG. 14 is an enlarged top plan view of that portion of the machine of this invention which effects a joining of the top and bottom conduit pieces, and which facilitates a fastening of the pieces together by the use of the punched tabs.

FIG. 15 is a longitudinal sectional view, taken generally along the line XV—XV of FIG. 14, and wherein further detail of the joining and fastening operations is illustrated.

FIG. 16 is an enlarged transverse sectional view, taken generally along the line XVI—XVI of FIG. 15, and wherein one stage of the joining operation is illustrated, with the phantom and full lines, respectively, illustrating the relative positions of the pieces just prior to, and just subsequent to the joining being effected.

FIG. 17 is an enlarged fragmentary transverse sectional view, taken generally along the line XVII—XVII of FIG. 15, and wherein the conduit pieces of this invention are clearly illustrated, just as the tabs of the upper piece are fastened beneath edges of the lower piece.

Figure 2:
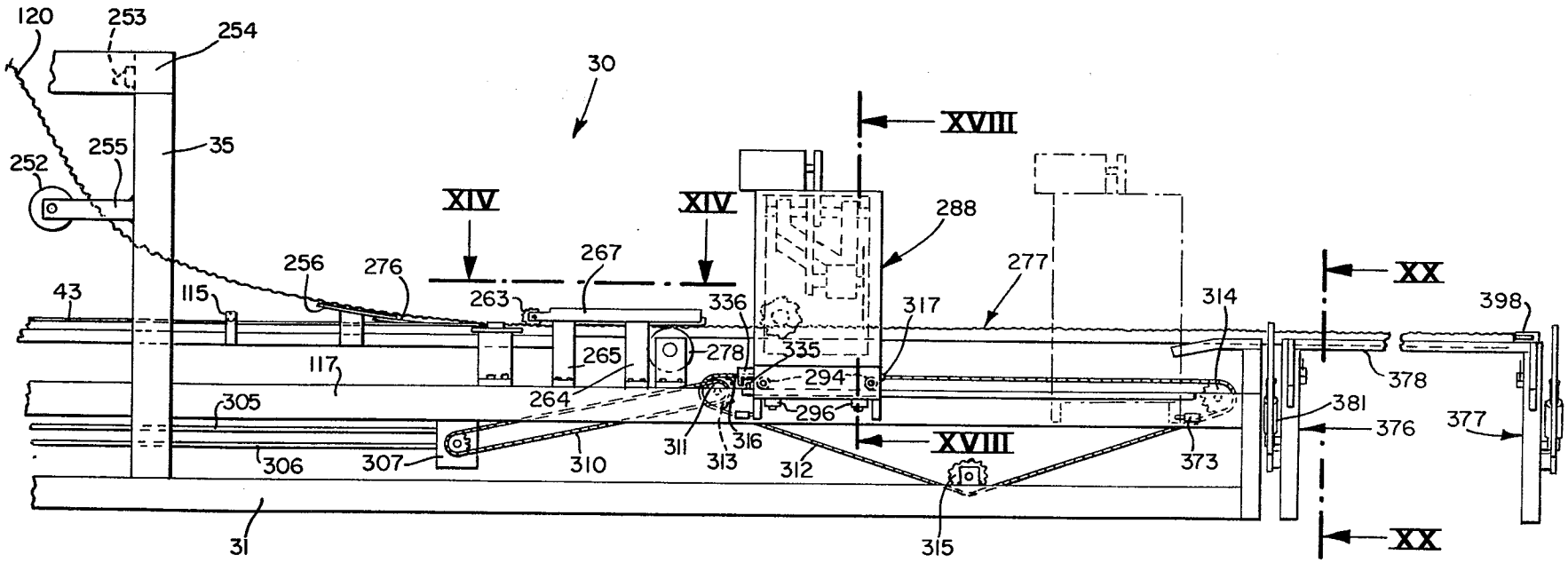
FIG. 2 is a side elevational view of the remainder of the machine of this invention.

FIG. 18 is an enlarged transverse sectional view, through the sawing or cutting mechanism of this invention, taken generally along the line XVIII—XVIII of FIG. 2, and wherein the saw is illustrated in both full line and phantom position, for illustration, respectivelyk of its end positions of movement.

FIG. 19 is fragmentary longitudinal sectional view, taken generally along the line XIX—XIX of FIG. 18, and wherein various devices of the cutting mechanism are more clearly illustrated.

Figure 20:
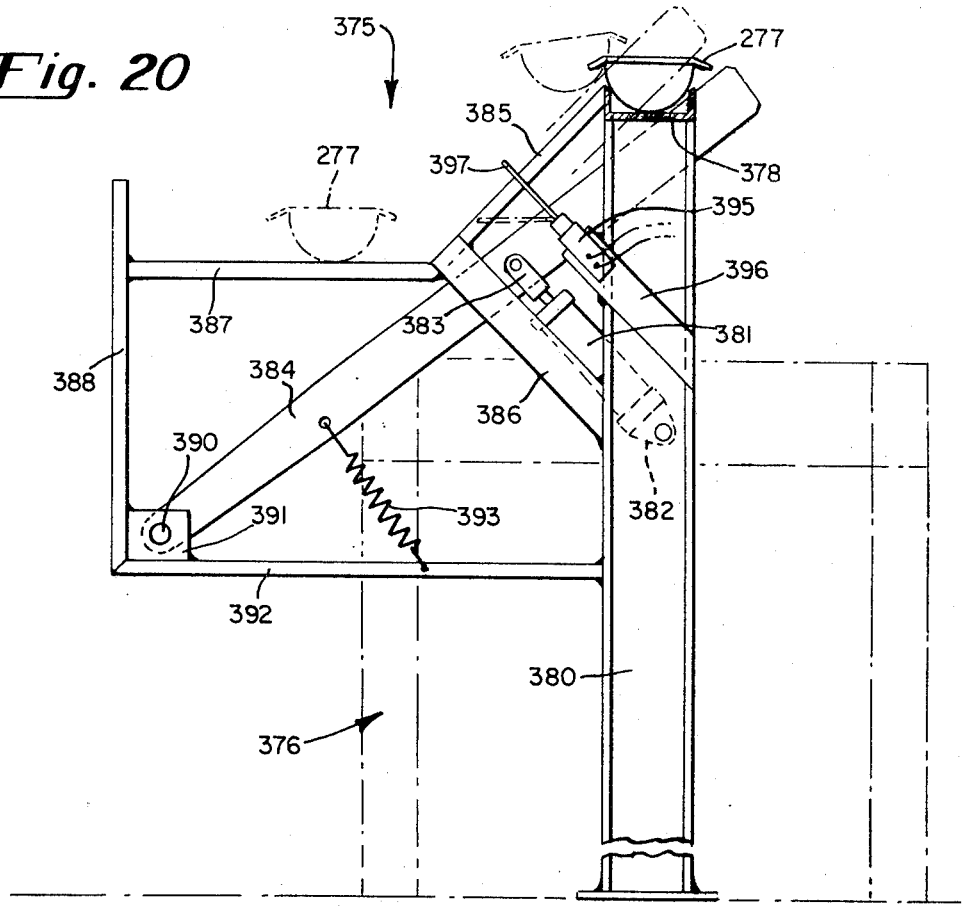

FIG. 20 is an enlarged transverse sectional view, taken generally along the line XX—XX of FIG. 2, and wherein the ejecting mechanism is illustrated.

Figure 21:
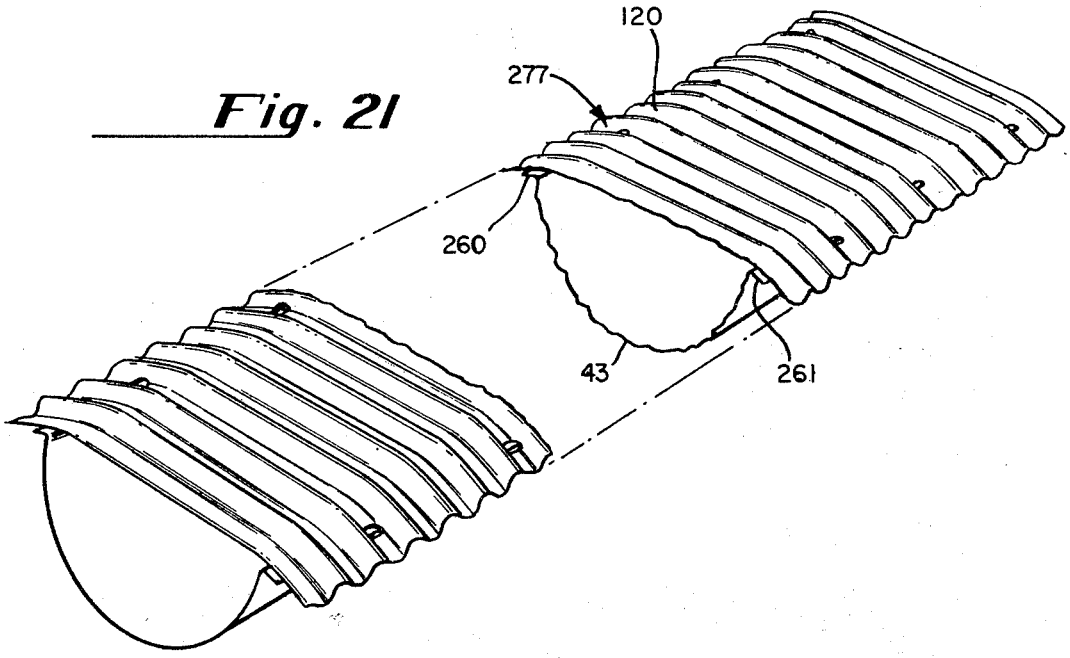

FIG. 21 is a top perspective view of a conduit of two piece construction, made in accordance with the machine of this invention.

Figure 22:
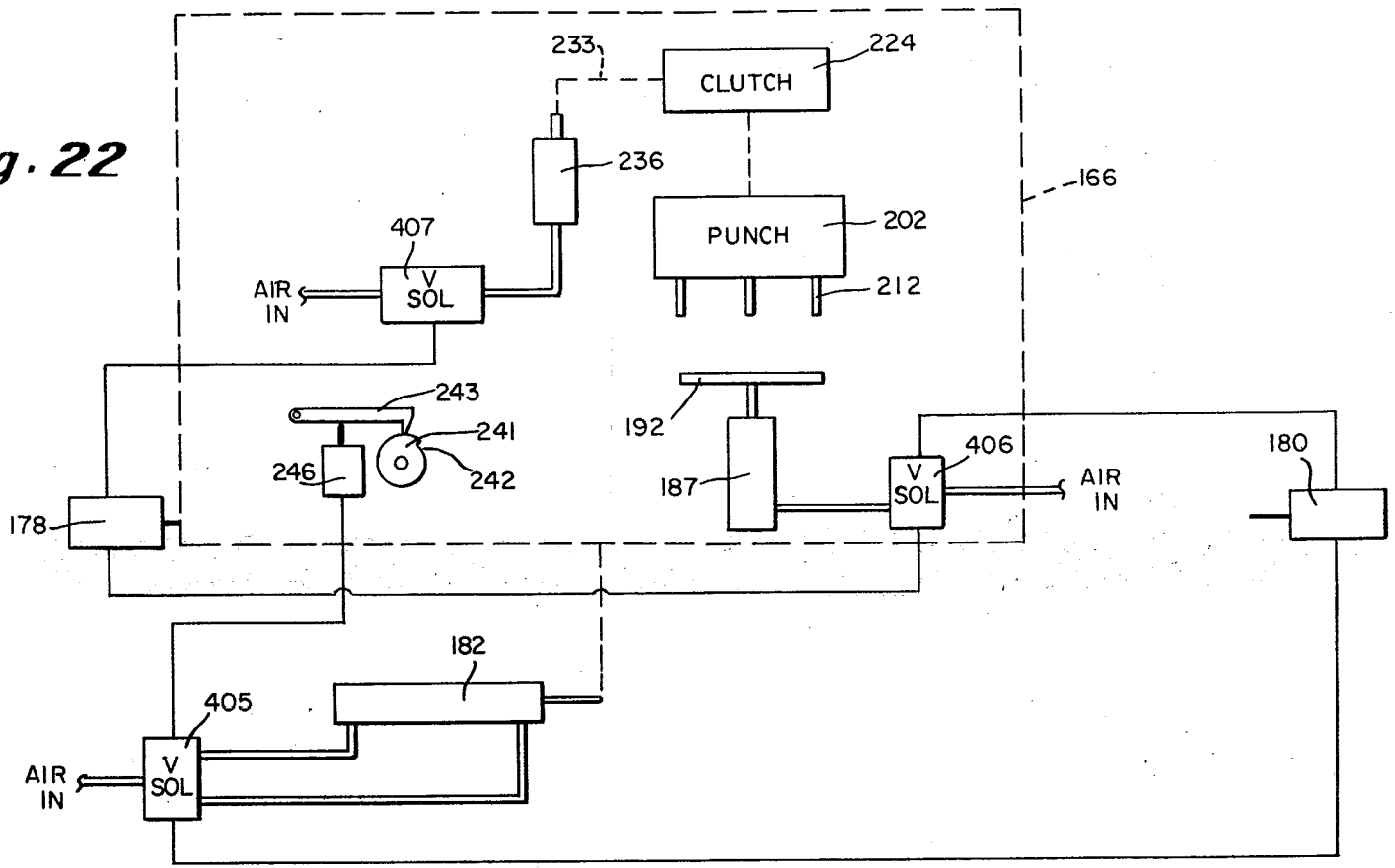

FIG. 22 is a schematic diagram of the controls for operating various components of the punching mechanism of this invention, and for facilitating the back-and-forth movement thereof.

Figure 23:
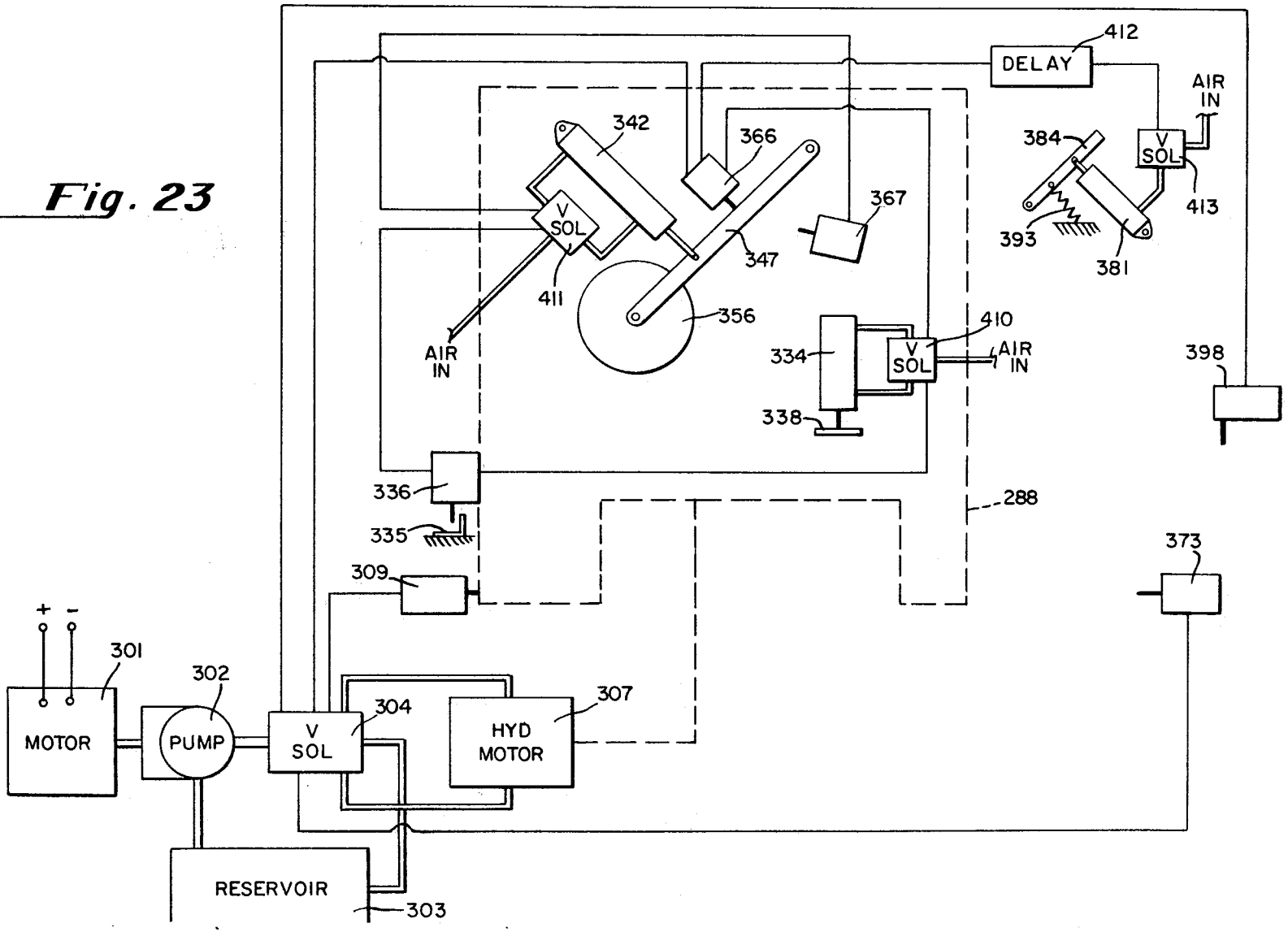

FIG. 23 is a schematic diagram for illustrating the various controls for the sawing or cutting mechanism of this invention, and for the back-and-forth movement of the saw carriage.

FIG. 24 is a fragmentary side elevational view of a portion of the machine of this invention, but wherein a preferred embodiment of the punching apparatus, as a preferred alternative to that illustrated in FIG. 1, is illustrated.

Figure 25:
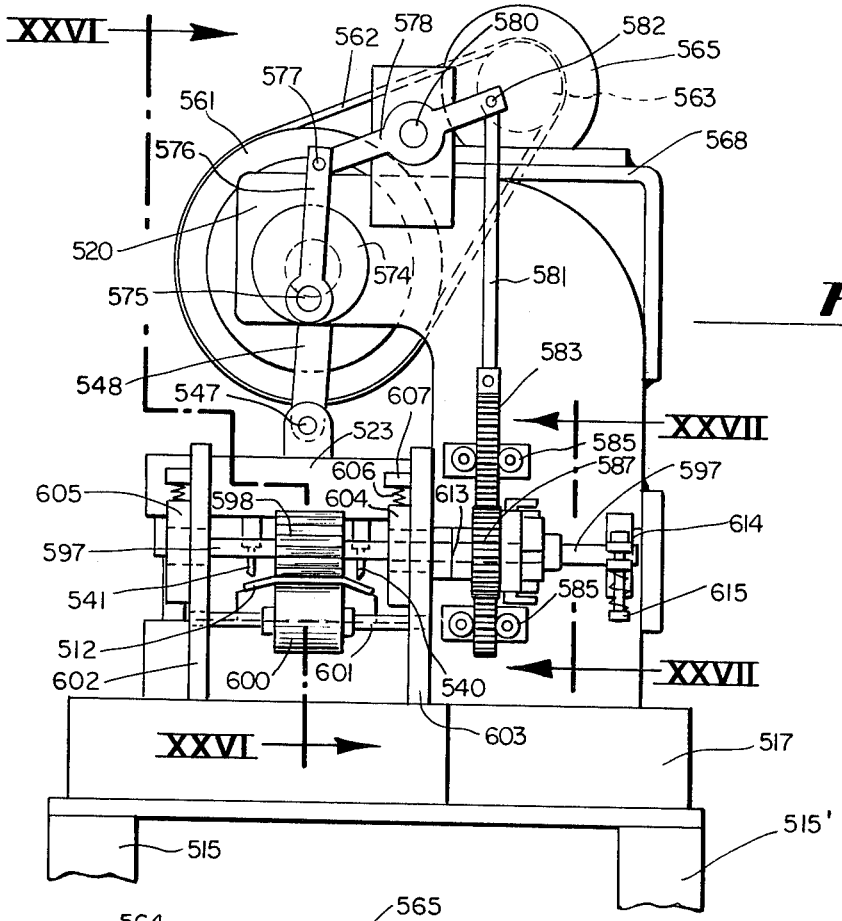

FIG. 25 is an enlarged end view of the punching apparatus of the embodiment of FIG. 24, taken generally along the line XXV—XXV of FIG. 24.

Figure 26:
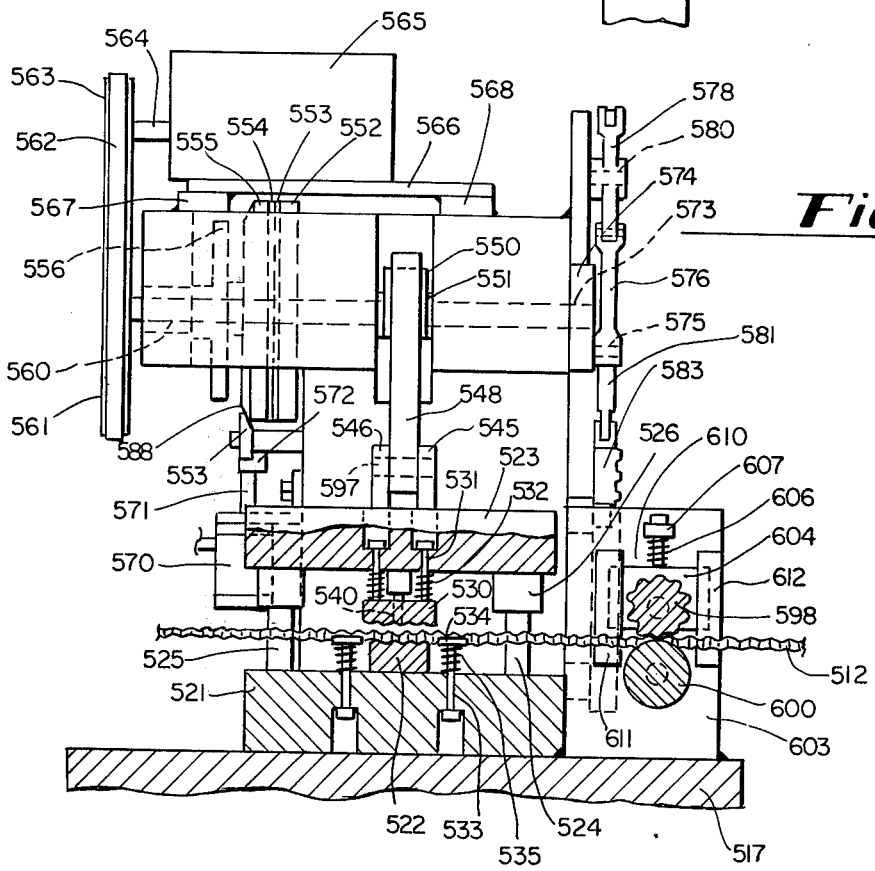

FIG. 26 is a view taken generally along the line XXVI—XXVI of FIG. 25, and wherein a portion of the punching apparatus of FIG. 25 is illustrated in side elevational view, and with a lower portion thereof being illustrated in vertical sectional view, for the sake of clarity.

FIG. 27 is an enlarged fragmentary rear view of a portion of the intermittent or ratchet-type drive for an upper sheet through the punching apparatus of this invention, taken generally along the line XXVII—XXVII of FIG. 25.

FIG. 28 is a fragmentary vertical sectional view taken through the ratchet structure illustrated in FIG. 27, generally along the line XXVIII—XXVIII of FIG. 27.

FIG. 29 is a schematic diagram of the controls for operating the components of the punching mechanism of the embodiment illustrated in FIGS. 25 through 28.

FIG. 30 is a schematic diagram illustrating various of the motions of the punching mechanism of the embodiment of FIGS. 25 through 30.

DESCRIPTION OF THE PREFERRED EMBODIMENTS

Referring now to the drawings in detail, reference is first made to FIG. 1, wherein the machine, generally designated by the numeral 30 is illustrated.

The machine 30 includes generally horizontally disposed support members 31, a plurality of vertical supports 32, 33 and 33', 34 and 34' and 35 are provided, with horizontal supports 36, 37 and 37' being carried thereby, with all of the supports being suitably secured, as by being bolted, welded or the like, where applicable, for rigid support of the various machine components. In some instances comparable structures illustrated on an opposite side of the machine are illustrated with prime (') numbers corresponding to a similar number on that side of the machine illustrated in FIG. 1, and in those instances in which no similar structural component is illustrated anywhere in the drawings, only the component illustrated in the drawings is numbered, although a similar component may exist across the machine.

A reel 38 is provided, having a roll of sheet metal material wound about a core (not illustrated), with a plurality of end guides 40 being carried by suitable end plates 41 thereof, and with the reel 38 being mounted for rotation in the direction of the arrow illustrated adjacent the reel 38 in FIG. 1, with the reel 38 being carried on suitable supports 42, adapted to facilitate the free unrolling of bottom sheet material 43 therefrom.

The sheet material 43 then passes through a pair of calender rolls 44 and 45 that are mounted for rotation in mounting blocks 46 and 47, carried by respective vertical supports 33 and 33'. The rolls 44 and 45 are adapted to straighten out any kinks in the bottom piece 43, as the same is unrolled, and to generally maintain the sheet 43 in flattened form, as the same is fed into the bottom piece forming section 48.

With particular reference to FIGS. 1 and 3, the bottom piece-forming section 48 includes a plurality of forming stations 50, 51, 52, 53 and 54, for progressively forming the sheet 43, from a flat sheet, into a sheet having the cross-sectional configuration illustrated schematically in full lines in FIG. 6. Each of the stations 50 through 54 comprises a driven upper roll and a driven lower roll, with suitable idler wheels at sides of the rolls, as will be discussed hereinafter. The rolls at any given station 50 through 54, while varying progressively through the machine, have their shafts, such as those 55 and 56, for station 50 mounted similarly, so all not need be fully illustrated.

The shaft 55 is mounted for rotation in suitable frictionless bearings 57 and 58, that are adjustably carried for movement in a vertical direction, as necessary for adjustment, in guideways 60 and 61, respectively. The lower shaft 56 is fixedly mounted in frictionless bearings 62 and 63, that are fixedly carried within the guideways 60 and 61, respectively, for rotation of the shaft 56. At the top of the guideways 60 and 61, are a pair of horizontally disposed plates 62 and 63, with tapped holes 64 therein, each receiving a threaded set screw 65, in threaded relation, and which has a suitable lock nut 66 thereon, with the screw 65 extending into the way 60 or 61, to engage the tapped hole 67 of an adjustment block 68. The adjustment block 68 engages the frictionless bearing 57. A similar arrangement is provided for the frictionless bearing 58, and for the other frictionless bearing at the end of the shaft of the upper rollers at each of stations 50 through 54. Thus, each of the upper rollers at the stations 50 through 54 are adjustable, to accommodate variations of thickness of the material sheet 43, or the like. The shafts 55 and 56 are geared together, by suitable gears 70 and 71, for synchronous driving in opposite directions, with the shaft 55 being driven in a counterclockwise direction, as viewed from the end illustrated in FIG. 1, and with the shaft 56 being driven in a clockwise direction, as viewed from the machine side illustrated in FIG. 1. It will be noted that the gears 70 and 71 are of different size, for driving of the lower shaft 56 at a greater speed than that of the upper shaft 55. This is because the portions of the rolls driven by the shafts 55 and 56, that are adapted to driveingly engage a sheet 43 are at varying distances from the centers of rotation of the shafts 55 and 56, and accordingly, in some instances, it is necessary to drive the upper and lower rolls at the stations 50 through 54 at different speeds relative to each other, in order to minimize sliding of rolls across the sheet material 43, wherever possible.

The shaft 55, and like shafts for the upper rolls of each of stations 51 through 54 are driven by a common chain 72, engaged with sprockets 73, mounted at ends of the shafts, as illustrated in FIG. 1, with the chain 72 passing beneath suitable idler sprockets 74, for maintaining a chain 72 in secure engagement with the sprockets 73. A drive sprocket 75 is provided, carried by vertical support 34, and suitably mounted for rotation thereon, with the sprocket 75 being driven through several speed reduction stages provided by chains 76, 77, 78 and several sprocket arrangements 80, 81 and 82, all of which are driven by a suitable motor 83, mounted on horizontal bottom supports 31.

A roller 84 is mounted on the shaft 55, for rotation therewith, and being keyed thereto (not illustrated), for driving the roller 84 from the shaft 55. At ends of the roller 84 are pairs of idlers 85 and 86, which are not driven by the shaft 55. Similar idlers at various stations 51 through 54 are adapted to engage edge portions of the sheet 43 as the same is carried therepast, and to bend the same as illustrated in the various phantom stages of FIG. 6, outwardly, to provide outwardly extending lips for the sheet 43.

A bottom roll 87 is keyed to the shaft 56 at station 50, similarly, with the roll 87 being provided with idlers 88 and 90, at sides thereof, with the idlers 88 and 90 being mounted for rotation relative to the shaft 56, but being adapted to exert inwardly and upwardly bending forces on the sheet 43, and with the idlers 88 and 90 being provided with suitable thrust bushings 91 and 92 pinned to the shaft 56, by suitable pins 93 and 94, to prevent endwise movement of the members 91 and 92, under the bending forces applied to the sheet 43. As has been mentioned above, the end rolls 88 and 90 are not driven from the shaft 56, in order to prevent excessive sliding, in that, it is desired that the sheet 43 pass at a predetermined selected linear speed through the various roll stations 50 through 54, and, if the rolls 88 and 90 were driven in addition to the roll 87 being driven, because such rolls have varying peripherys, unncessary sliding and surface working of the sheet 43 would take place, in addition to loss of control of the linear speed of the sheet 43 through the various stations 50 through 54. Thus, the sheet 43 would be driven at its center by the roll 87. Also, it will be noted that the rolls 84, 87, 88 and 90 are selected in configuration, to yield a desired configuration at stage 50, for the sheet 43 passing therethrough, and that such configurations cooperate in each of the various stations 50 through 54, to alter the cross-sectional configuration of the sheet 43, from the flat sheet form illustrated in phantom in FIG. 6, just prior to station 50, to vary progressively through the various phantom stages illustrated in FIG. 6, to the full line illustration of FIG. 6, that occurs at station 54.

At station 54, upper and lower shafts 93 and 94, are mounted similar to the shaft mountings illustrated in FIG. 4, with the use of ways 60 and 61 carried by the horizontal supports 49 and 49', with the shaft 93, being similarly adjustable. The shaft 93 has a roller 95 keyed thereto, with the roller 95 being of a desired cross-section for completion of the configuration of the bottom conduit piece 43, as illustrated in FIG. 5, to have the general configuration of the full line illustration of FIG. 6. At the ends of the roller 95 are provided a pair of idlers 96 and 97, being mounted for rotatioan relative to the shaft 93, and being provided with end thrust members 98 and 100 suitably pinned to the shaft 93, by pins 100 and 102, with the surface configuration of the idler rolls 96 and 97 being adapted to complete the configuration of the edge or lip portions of the bottom conduit piece 43, as illustrated in FIG. 5.

A roller 103 is keyed to the shaft 94, as illustrated in FIG. 5, and is provided with idler rollers 104 and 105, at ends thereof, with suitable thrust members 106 and 107 being pinned by pins 108 and 110 to the shaft 94, for maintaining position of the idlers 104 and 105 on the shaft 94. It will be noted that the rollers 104, 103 and 105, in the aggregate, define on their surfaces a generally concave transverse configuration, which cooperates with the generally convex configuration defined by the roller 95, to yield the desired configuration for the bottom piece 43 illustrated in FIG. 5, and with the rollers 104 and 105 also being configured to define the desired configuration for the underneath surfaces of the outer edges or lips of the bottom conduit piece 43, also as illustrated in FIG. 5, and in the full line illustration of FIG. 6.

The bottom piece 43 upon leaving the station 54, then continues in its longitudinal path through the machine 30, in a direction of the arrow 111 illustrated in FIG. 1, along its predetermined path defined in part by a suitable roller bed 112 or the like, carried by vertical supports 116, mounted on horizontal supports 117, and with holdowns 113, 114 and 115, being provided to maintain the desired horizontal position of the bottom conduit piece 43 traveling therealong.

A reel 118 of sheet material 120 for forming the upper conduit piece is provided, with the reel 118 being mounted on suitable mounting blocks 121, for rotation, generally similar to the reel 38, as the sheet material 120 is unwound therefrom.

A plurality of upper piece straightening rollers 122 and 123 are provided, carried in suitable mounting blocks 124 and 125 carried by vertical supports 33 and 33', for straightening the sheet 120 as it is delivered to a corrugation station 126. At the corrugation station 126, a generally sinusoidally configured periphery 127 is provided for a bottom corrugated roll 128, which is mounted on a suitable shaft 130, and keyed thereto, for rotation therewith, with the shaft 130 being provided with a sprocket 131, mounted thereon, which is diven from a smaller sprocket 132, with the sprocket 132 being mounted on a shaft 133, which in turn is driven from a larger sprocket 134, through a chain 135, with the chain 135 being driven from the shaft of the sprocket arrangement 80. Thus, it is seen that the lower corrugating roll 128 is driven by the motor 83.

The corrugating roll 128 is mounted in a way, but fixed mounted therein, whereas the upper roll 137, which also has a sinusoidally configured periphery 138, is mounted for vertical adjustment in the way 136, by means of suitable adjusting screws 140 and 141, generally similar to the arrangement of the upper rolls in each of the stations 50 through 54, so such arrangement need not be repreated in detail herein. However, the adjusting screw 140 facilitate the upward and downward adjustment of sliding blocks 141 and 142 in vertically carried channels such as that 143, which channels are carried by suitable vertical supports 33, 33', 144 and 144'. The corrugating roll 137 is keyed or otherwise secured to a shaft 145, and the shaft carries a sprocket 146 secured to its other end which sprocket 146 is driven from the bottom sprocket 149 carried by the shaft 130. It will be seen, by reference to FIG. 8, in particular, that the upper sheet 120, is provided with transverse corrugations 147, therein.

The corrugated upper conduit piece 120 then passes horizontally, in the direction of the arrow 148 in FIG. 1, to the edge bending station 150. At the edge bending station 150, a plurality of vertical supports (unnumbered) provide suitable ways 151, for upper and lower shafts 152 and 153 respectively. The lower shaft 153 is fixedly mounted, and carries, keyed or press-fitted, or otherwise secured to its periphery, a plurality of corrugation engaging drive members 154 and 155 which engage beneath the corrugated sheet 120, at outer side edges thereof, as corresponding upper corrugation-engaging members 156 and 157, carried by an upper shaft 158 engaged upper surface portions of the cover sheet 120, alongside opposite edges thereof, for bending the upper edges of the sheet 120 downwardly, as viewed in FIGS. 7 and 9, as the corrugated sheet 120 passes therebeneath. It will be noted that the upper corrugated-periphery rolls 156 and 157 are not driven, but are idler rolls, although the same could be driven, if desired.

The shaft 158 which carries the rolls 156 and 157 also carries a central member 160, adapted to engage the upper central portion of the cover member 120 as the same passes therebeneath, in order to maintain the upper central surface portion of the cover sheet 120 to be generally flat, as illustrated in FIG. 9. Similarly, the lower shaft 153 carries a central member 161, that extends between members 154 and 155, also for the purpose of maintaining the generally flat position of the central portion of the upper sheet member 120, and further to space the members 154 and 155. The shaft 158 is adjustably positionable, in the vertical direction in the way 151, by a suitable pair of threaded members 162 and 163, which carry sliding blocks 164, in which the ends of the shaft 158 are mounted, generally similar to any of the upper shaft mountings for the stations 50 through 54 in FIG. 3.

It will be seen that the cover sheet 120, leaving the station 150, is corrugated and has downwardly bent edge portions, on oppsite sides thereof, as the cover piece 120 is delivered to a punching station 165.

With particular reference to FIGS. 10 through 13, the punching station 165 is illustrated as being mounted as a carriage 166, movable on a plurality of rollers such as those 167, 168, 169 and 170 illustrated in FIG. 10, with the rollers being carried for rotation relative to suitable upstanding plates 171 and 172, welded or otherwise suitably secured to horizontal support members 37' and 37. Thus, the punch carriage 166 is movable rightward and leftward, as viewed in FIG. 1, or in the direction of travel of the upper piece 120, and in a direction reverse thereto, with a carriage mainplate 173 being provided with runways 174 and 175, disposed along front and rear sides thereof, as viewed in FIG. 1, and extending into and out of the plane of the paper, as viewed in FIG. 10, for engagement on upper and lower surfaces thereof by suitable rollers 167, 168, 169 and 170. A pair of lugs 176 and 177, are laterally spaced from, and extend outwardly of the runway 175 of the carriage plate 173, for engagement by and actuation of a pair of spaced limit switches 178 and 180, respectively, at end limits of travel of the carriage 166, for reversing the direction of movement of the carriage 166, in a manner which will later be described herein.

Extending between the horizontal supports 37 and 37′ is a hoizontal connecting support 181. A yoke mounted pressure cylinder 182 is mounted on the support 181, and is horizontally disposed, and has connected at its right end thereof, as viewed in FIG. 1, an L-shaped link 183, with the vertical leg 184 of the link being welded at 185 to a horizontal plate 186 of the carriage 166. Thus, upon actuation of the cylinder 182 in the desired direction, the carriage 166 would be driven through the link 184 in the desired direction, longitudinally of the machine 30.

A pneumatic piston cylinder 187 is mounted on and carried by the lower end of the plate 186, by suitable bolts 188, over a clearance hole 190 in the plate 186. A push rod 191 is carried by and movable with the piston (unnumbered) of the cylinder 187, for vertical upward movement upon actuation of the cylinder 187, to bring a lower clamping plate 192 into engagement beneath the upper conduit piece 120, as illustrated in FIG. 11. The upwardly movable plate 192 effects a clamping of a piece 120 against an upper plate 193, which, in turn, is carried by and secured in position relative to the carriage plate 186 on a pair of inverted U-shaped supports 194 and 195, which in turn are welded or otherwise suitably secured to mounting blocks 196 and 197, which are carried by the carriage plate 186.

A plurality of alignment posts 198 are carried by the carriage plate 186, and are slidably received in bosses 201, with the bosses 201 being carried by punch plate 202 for maintaining punch alignment during relative vertical movement between the posts 198 and a vertically movable punch plate 202. The punch plate 202 has a yoke 203 welded to an upper surface thereof, with the yoke 203 being connected to a crank arm 204, with the crank arm being mounted for rotation at its upper end about an eccentric 205 that is, in turn, fixedly carried by a shaft 206, with the shaft 206 being mounted in bearings 207, for rotation therein, with the bearings 207 being carried by opposite legs 208 and 210 of an upper punch support 211. Thus, upon rotation of the shaft 206, the punch plate 202 is adapted to be vertically reciprocated.

A plurality of punching elements 212 are provided, carried by the lower end of the plate 202, for movement therewith. As illustrated in the drawings, six separate punching elements 212 are provided, for simultaneously punching six separate tabs from the upper conduit sheet 120, upon downward movement of the plate 202.

The shaft 206 is provided with an end plate 213, which, in turn, has a clutch facing 214 thereon. Another shaft 215, is mounted in a bearing 216, of another portion of the upper support 211, for rotation therein, with the shaft 215 being driven from a pulley 217, which in turn is driven by a belt 218 from another pulley 220, with the pulley 220 being carried by the shaft of a motor 221. The motor 221 is carried on a support 222 that is welded or otherwise secured to the upper support 211 of the carriage 166, and to a vertical support 223 thereof, as illustrated in FIG. 10.

A clutch disk 224 is keyed to the shaft 215, as illustrated in FIG. 11, and is provided with clutch facing 225 thereon. A spring back-up plate 226 is secured by means of a pin 227 or the like, to the shaft 215, for rotation therewith, and with a plurality of springs 228 being provided for urging the clutch plate 224 leftward along the shaft 215, as viewed in FIG. 11, until its clutch facing 225 comes into engagement with the facing 214 of the plate 213, and with the plate 224 sliding longitudinally of the shaft 215 in its leftward movement, for transmitting torque from the shaft 215 to the shaft 206, for rotationally driving the same, for vertical movement of the punch plate 202. The clutch plate 224 is actuated by engagement of a shoe 230 with a surface 231 thereof, with mating surfaces of the shoe 230 and the clutch plate 224 being chamfered as at 232 and 231, respectively, and with the shoe 230 being carried by a link 233 which is centrally pivotally mounted at 234 on the carriage fixture portion 210, with the rightmost end of the link 233 being pivotally mounted at 235 as shown in FIG. 12, to be actuated by a cylinder 236, preferably of the pneumatic type, such that upon energizing of the cylinder 236, to pull the piston (unnumbered) thereof downwardly, and consequently to pull the rod 237 thereof downwardly, the shoe 230 will be pushed upwardly to engage the surface 231 of the clutch plate and thereby provide rotational movement to the shaft 206.

A follower 238 of the starwheel type, having a predetermined number of ridges on its surface thereof, as viewed in FIG. 11, is mounted on a shaft (not illustrated), with the shaft being mounted for rotation within a mounting block 240, which in turn is carried by the plate 174, as illustrated in FIG. 11, and with a camwheel 241 having a notch 242 therein being also carried by the starwheel shaft (not shown). Thus, as the upper conduit piece 120 moves rightward as viewed in FIG. 11, the starwheel 238 is driven in a counterclockwise direction by its engagement within corrugations of the piece 120, with the camwheel 241 also moving counterclockwise until a pawl 243, pivotally carried by the plate 204 at a pivot 244 thereof, drops into engagement with the notch 242, the pawl 243 being spring biased by a suitable extension spring 245, extending between the plate 186 and the pawl 243, as illustrated in FIG. 11. The location of the notch 242 on the wheel 241 is predetermined, in accordance with the setting and number of stars in the starwheel 238, to correspond with the spacing between corrugations of the piece 120, so that, upon dropping of the pawl 243 into the notch 242, a switch 246 will be energized to allow the cylinder 182 to become energized, for movement of the carriage 166 rightward, as viewed in FIG. 1. It will thus be clear, that the position and location of the pawl 243, notch 242, and starwheel 238, relative to the piece 120 determine the position of the carriage 166 relative to the piece 120, to assure that the punching elements 212 are always aligned to depressions of the corrugations. Thus, without the location of the pawl 243 in the notch 242, and therefore, without proper alignment of the carriage relative to the piece 120, the cylinder 182 will never be energized for movement of the carriage 166. Also, although the upper conduit-forming piece 120 is provided with a rightward drive by the corrugating rollers, for example, the presence of the starwheel 238, also facilitates the synchronizing of the motion of the piece 120 with that of the carriage 166, in that, with the cylinder 182 providing rightward motion for the carriage 166, as viewed in FIGS. 1 and 11, if the cylinder 182 is energized sufficient to allow the carriage 166 to overtake the speed of the cover piece 120, as the carriage 166 moves, so does the starwheel mount 240, and consequently the starwheel 238 follows corrugations of the piece 120, keeping the camwheel 241 positioned for engagement of its stop surface 247 by the pawl 243, which, in turn, prevents relative movement between the camwheel 241 and the pawl 243, such that the cylinder 182 can only drive the carriage 166 at the speed of travel of the upper conduit piece 120 through the punching apparatus 165.

With particular reference to FIG. 13, it will be seen that each punching element 212 will punch tabs 248 from bottoms, lands or recesses 250 of an upper conduit sheet or piece 120, with the tabs 248 being connected to the lands 250, just inside side edges 251 thereof, as viewed in FIG. 13.

The corrugated and punched piece 120 then continues its longitudinal movement, through its predetermined path, through the machine 30, traveling downwardly, as viewed at the right end of FIG. 1, and at the left end of FIG. 2. The piece 120 passes between a rotatable idler wheel 252 and a limit switch 253, in order to allow a slight excess of cover piece 120 to accummulate prior to joining it with the lower piece 43, in a manner to be later described, but with the switch 253 being actuated, such that, should too much of the cover sheet 120 accumulate relative to the bottom piece 43, it will hit the switch 253, and shut down the entire machine. The switch 253 is carried by a horizontal support 254 extending between the horizontal supports 37 and 37'. The wheel 252 is carried by a support 255 therefor, which, in turn, is carried by the vertical support 35.

As the upper piece 120 is delivered rightwardly through the machine as illustrated in FIG. 2, it passes over a support 256, with the lower piece 43 then passing, as viewed in FIGS. 14 and 16, between a pair of idler wheels 257 and 258, carried on suitable brackets 260 and 261, respectively, which, in turn, are mounted on horizontal supports 117 and 117'. As illustrated most particularly in FIG. 16, the wheels 257 and 258 are adapted to engage outer upper surfaces of the arcuately curved bottom member, and to bend such portions inwardly, within the elastic limit, a slight amount, such that outer lips 260 and 261 of the bottom member will be spaced a distance from each other, less than the spacing between inner edges of punched tabs 248 and 249. After passing the rollers 257 and 258, the upper and lower pieces 120 and 43, respectively, then pass over a series of bottom rollers 262 which support the bottom piece 43, while a corrugated roller (also an idler roller) 263 urges the corrugated upper piece 120, downwardly into engagement with the lower piece 43, as illustrated in the full line positions of FIG. 16. The rollers 262 are carried by suitable horizontal supports 263, which, in turn, are carried by the horizontal support 112. Vertical supports 264 and 265 are also provided, carried by the horizontal support 117, for carrying spaced horizontal bars 266 and 267, with the shaft 268 for the corrugated wheel 263 being carried for mounting the corrugated wheel 263, therebetween. A plurality of transverse bars 268, 270 and 271 are provided, carried by an extending between the bars 266 and 267, as illustrated in FIGS. 14 and 15. A longitudinally disposed bar 272, extends between the bars 268 and 270, and has a lower surface adapted to engage the upper surface of the corrugated piece 120 as the corrugated piece 120 passes therebeneath, in sliding engagement, to maintain the vertical position of the corrugated piece 120 as the bottom piece 43 passes outside interior rollers 273 and 274, which are disposed inside the arcuate piece 43, as illustrated in FIG. 16, and to assure that the outward biasing force of the rollers 273 and 274 do not raise the position of one or more of the pieces 120 and/or 43, above the desired predetermined positions of those pieces at this stage. The rollers 273 and 274 are mounted as idlers, on a transverse bar 275, with the transverse bar being carried by a longitudinally extending bar 276. The longitudinally extending bar 276, extends between the upper and lower pieces 120 and 43, as illustrated in FIGS. 14 and 15, and is carried by the support 256 illustrated in FIG. 2, to be unsupported at its right end as viewed in FIGS. 14 and 15. As the upper and lower pieces 120 and 43, respectively, pass by the rollers 273 and 274, and beneath the piece 272, the sidewalls of the piece 43 are moved outwardly of the full line positions illustrated in FIG. 16, to phantom line positions illustrated in FIG. 16, whereby the lips 261 and 260 engage the downwardly bent tabs 248 and 249, respectively, as illustrated in phantom in FIG. 16. This joining of the upper piece 120 and lower piece 43 yields a two piece conduit 277. The conduit 277 then continues its rightward movement, as viewed in FIG. 15, until it passes over idler wheels 278 and 280 that are mounted on suitable shafts 281, that in turn are carried by suitable supports 282 and 283, disposed on horizontal supports 117' and 117, respectively. A pair of longitudinal supports 284 and 285 are carried between the transverse supports 270 and 271, and carry a plurality of idler rollers 286, for engaging the downwardly bent portions of the cover piece 120, for backing-up the conduit 277, as the wheels 278 and 280 press the downwardly bent tabs 248 upwardly, as illustrated in FIG. 17, such that the tabs 248 and 249 engage beneath the lips 261 and 260 of the bottom piece 43, respectively, as illustrated in FIG. 17.

At this stage of the machine, the conduit 277 is completely formed, and need only be cut to length. A severing mechanism 288 is provided, which is longitudinally movable, in a back-and-forth motion, similar to that of the punching mechanism 165 mentioned above. The cutting mechanism 288 is therefore also of the carriage type, and includes a pair of transverse members 290 and 291, which carry plates 292 and 293 therebetween, on opposite sides of the horizontal supports 117 and 117', with rollers 294, 295, 296 and 297 being carried thereby. The rollers 294 and 295 are in engagement with upper track surfaces of horizontal members 298 and 300, which are welded or otherwise suitably carried by the horizontal supports 117 and 117', respectively. The rollers 296 and 297 are in engagement with outer vertical surfaces of the horizontal supports 117 and 117', as illustrated in FIG. 18, with all of the rollers 294 through 297, cooperating to stabilize the carriage 288, in its backward and forward movement relative to stationary portions of the machine 30.

The carriage 288 is moved by the use of an electric motor 301, as illustrated in FIG. 1, which drives a pump 302, for pumping an oil or other hydraulic fluid from a reservoir 303, through a solenoid valve 304, to deliver hydraulic fluid under pressure through either of the lines 305 or 306, depending upon the desired longitudinal direction of drive for the carriage 288, with the high pressure fluid in one of the lines 305 or 306 being adapted for actuating a hydraulic motor 307, which translates the pressure therein into a rotational driving force applied through a sprocket 308, to provide driving force through a chain 310 through a suitable reduction pair of sprockets 311 which in turn drives a chain 312, with the chain 312 being carried by sprockets 313, 314 and 315, and with opposite ends 316 and 317 of the chain being connected to the carriage 288 by any suitable means, such that, when the chain 312 is driven in one direction, the carriage is pulled in that desired direction, and when the direction of movement of the chain is reversed, the movement of the carriage is also reversed.

A pair of seats 318 and 320 are provided, with arcuate upper surfaces, for engaging a bottom of the conduit 277 and seating the same therein. The seats 318 and 320 are carried on longitudinally directed supports 321 and 322, which extend between and are welded to transverse supports 290 and 291.

A starwheel 323, having a ribbed periphery is provided, for engagement within recesses of the corrugated upper surface of the conduit 277 passing therebeneath, with the starwheel 323 being shaft-mounted for idler motion, on pillow block bearings 324 and 325 or the like, and with the starwheel 323 being keyed or otherwise suitably secured to the shaft 326 extended between the bearings 324 and 325. The bearings 324 and 325 are carried by suitable vertical supports 327 and 328, mounted on the transverse support 290. At the rightmost end of the shaft 326, a notched wheel 330 is rotatably keyed thereto, having a plurality of notches 331 in the periphery thereof, for engagement therein of a hook 332 of a pawl 333, with the pawl 333 being carried on a shaft 334 for pivoting, and with the shaft 334 being carried by vertical support 335. The function of the starwheel 323 and of the notched periphery of the wheel 330, and of the pawl 333, taken together, it is basically the same as the function of the wheel 238 and pawl 243 illustrated in FIG. 11, of maintaining alignment between the carriage 288 and the piece 277, to assure cutting of the piece 277, always in lands of the corrugations, and to assure movement of the carriage 288, when such movement is in the forward or rightward direction as viewed in FIG. 2, as being at the same speed as the rightward movement of conduit 277. In this regard, the wheel 230 and pawl 233 are operative in the sense of a ratchet, such that, upon driving the carriage 288 leftward, as viewed in FIG. 2, the wheel 230 will be pivoted counterclockwise, and with the configurations of the notches 331 of the wheel 330 facilitating an upward camming of the pawl 333, which upper camming is discontinued upon reversing the motor 307, and resuming clockwise movement of the plate 330.

A pneumatic cylinder 334, is provided, for actuation by a lug 335, which is tripped by a protrusion 336 carried by the carriage 288, upon rightward movement of the carriage 288, for energizing the piston (not shown) within the cylinder 334.

The cylinder 334 carries a rod 337, which, upon energizing the cylinder 334, forces a plate 338 downwardly to clampingly engage the piece 277, by gripping the upper surface thereof, in urging the same against the seat 320, for effectively locking the carriage 288 to the conduit 277. The cylinder 334 is carried by a suitable transverse support 340, which, in turn, is carried by vertical supports 341.

The switch 336, when tripped by the lug 335, also provides for the actuation of a cylinder 342. The cylinder 342 is pivotally carried by a lug 343, which in turn, is carried by a longitudinally extending support 344, extending between vertical supports 345 of the carriage 288. The other end of the cylinder 342 is pivotally connected through a yoke 346, to a pivotal saw bar 347. The saw bar 347 is pivotally mounted on a shaft 348 through an arm 350 thereof in engagement with the shaft 348, as viewed in FIG. 19, for free sliding movement of the arm 350 relative to the shaft 348. The shaft 348 is fixedly carried at its ends by suitable mounts 351 and 352, carried by transversely disposed supports 353 of the carriage 288. At the lower end of the arm 347, as viewed in FIG. 19, there is provided a saw head 354. The saw head 354 has a shaft 355 extending therefrom, upon which is mounted a saw blade 356. It will be noted that the saw blade 356 may also comprise a grinding wheel, if the same is desired, and that nomenclature as used herein is intended to refer to any suitable rotatable cutting element for severing the conduit 277. The opposite end of the shaft 355 extends through the saw head 354, and is provided with a pulley 357, keyed or otherwise suitably secured thereto, as is the saw 356 keyed or otherwise suitably secured to the shaft 355. A driven pulley 358 drives the pulley 357 through a belt 360, with the pulley 358 being, in turn, driven by a pulley 361 that, is, in turn, driven by a belt 362 from a pulley 363. A motor 364, of the electric motor type, is mounted on a plate 365, carried by suitable horizontal supports 353 and 354, and the like, and drives the pulley 363. It will be noted that the pulleys 358 and 361 are not keyed to the shaft 348, but are free to rotate thereabout.

It will be clear from the above that the saw 356 is rotatably driven from the motor 364, and is adapted to be pushed through an arcuate path, between the full line position illustrated in FIG. 18, and the phantom line position illustrated therein, for the purpose of cutting through the conduit 277. The piston 342 exerts the pressure through the push rod thereof, and through the yoke 346, to engage the saw arm 347, and to provide such arcuate movement of the saw blade 356. A pair of switches 366 and 367 are carried by suitable supports 368 and 370, respectively, which, in turn are carried by suitable horizontal supports 371 and 372, which extend between vertical supports of the carriage 288, with the switches 366 and 367 being adapted to be engaged by opposite portions of the saw head 355, at terminal limits of its arcuate travel.

It will be seen that the carriage 288 is movable between the full line and phanton positions illustrated in FIG. 2, and is then reversed. However, the reversing movement of the carriage is effected by means of the switch 366, upon return of the saw 356, to its full line position illustrated in FIG. 18, in a manner which will hereinafter be discussed. In case of switch breakdown, an additional safety switch 373 is provided, carried by the horizontal support 117, to terminate longitudinally rightward movement of the carriage 288, and it is operative as herein later described. This switch 373 is a safety device only, and would not normally be operative during normal use of the machine.

It will be seen, that the conduit 277 is now severed into lengths of a desired preselected size.

With particular reference to FIG. 20, there is illustrated an ejector mechanism 375, which is operative to eject severed lengths of conduit 277, out of the path indicated in longitudinal view in FIG. 20, in order that such path may readily and timely accommodate a next serially delivered section of conduit 277. Accordingly, a pair of tandemly operative ejection stations 376 and 377 are provided, connected by a conduit-receiving channel 378, with the station 376 and 377 being identically operable, so that only one need be described in detail. The station 376 includes an upstanding vertical support 380, adapted to support one end of the horizontal channel 378. A cylinder 381, generally of the pneumatic type is pivotally mounted by a yoke 382 on the support 380, at one end of the cylinder 381, and is mounted at the other end by pivotal connection of a yoke 383, with a striker bar 384. Upon energizing the cylinder 381 of the ejection assembly 375, the bar 384 is pushed upwardly from the full line position illustrated in FIG. 20, to the phantom line position illustrated therein, to engage beneath the conduit section 277, and lift the same upwardly, whereby the conduit section 277 may slide down a slanted slide member 385, which is carried by an angularly upstanding support 386, to be engaged at its ends by horizontal rack supports 387 carried by the angular support 386, and by a vertical support 388. The striker bar 384 is pivotally mounted at its lower end on a suitable pivot 390, with the pivot 390 being carried by a block 391, which, along with the vertical rack support 388 is carried by a horizontal support member 392, which in turn is welded or otherwise suitably secured to the vertical support 380. The striker bar 384 is downwardly biased, toward its full line position, by a suitable extension spring 393 connecting the bar 384 and the bar 392, as illustrated in FIG. 20. A switch 395 is mounted on a suitable support 396 carried by the vertical support 30, and has a striker portion 397, for engagement by a conduit section 277 as such section slides down ramps 385, with the switch 395 being adapted to either actuate a counter for counting the number of pieces manufactured by the machine, or, if desired, to provide a suitable safety mechanism, as an overall machine shutdown, in the event of improper ejection of a severed piece of conduit 277, therefrom, as desired.

The operation of each of the ejection stations 376 and 377 taking place identically and concurrently, a given section 277 of conduit will be engaged simultaneously at each end, and fall generally level onto the horizontal rack supports 387. The ejected sections 277 may gather on the rack supports 387, until a given quantity has been compiled, and may then be moved therefrom, to storage, or the like, as desired. A switch 398 is carried at the right-most end of the channel 378 as viewed in FIG. 2, for the purpose of actuating the drive motor for the saw carriage 288, in a manner which will later be discussed, upon the unsawed length of conduit 277 reaching a desired predetermined length. Of course, the switch 398 may be located in any desired position, depending upon the length of conduit that is desired.

With reference to FIG. 21, it will be seen that there is provided a length of conduit 277, that is connstructed only of two pieces, namely an upper or cover piece 120 and a bottom or trough piece 43, with the bottom piece having outturned lips 260 and 261, and with the cover piece 120 having transverse corrugations therein, and with integral tabs 248 and 249 being struck from the cover piece 120, and from lands or recesses of the corrugations thereof, and with the tabs 248 and 249 being in fastening engagement beneath the lips 261 and 260, as discussed above with reference to FIG. 17. The opposite edges of the conduit are downwardly bent as illustrated in FIGS. 17 and 21. It will be seen that no additional fastening devices are required, and that the opposite downwardly bent edges of the cover portion 120 over-hang the outer edges of the outwardly bent lips of the trough portion 43, for preventing the accumulation of slit and the like therein, but yet to permit water seepage upwardly through the voids formed between the corrugations of the upper piece and the upper surfaces of the lips of the trough piece.

OPERATION OF THE CONTROLS OF THE ABOVE-DISCUSSED EMBODIMENT

In accordance with the operation of the device 30 of this invention, the motor 83 drives the trough forming section 48, and through the chain 135, also the corrugating station 126, drawing off material from the rolls 38 and 118, respectively. The edge bending apparatus 150 for the upper conduit piece 120 is not generally driven, so the piece 120 passes through the station 150 without being driven.

The punch carriage 166 is now positioned with the pawl 43 disposed within the notch 242 of the cam 241, the carriage 166 having terminated in this position during leftward or retracted movement of the carriage 166 after the next previous punching operation, as viewed in FIG. 1. With the pawl 243 thus positioned in notch 242, the switch 246 is actuated which opens the solonoid valve 405, to allow air to drive the piston and push rod of the cylinder 182, rightward, as viewed in either of FIGS. 1 or 22, thereby commencing rightward movement of the carriage 166. As the carriage 166 moves rightward as viewed in FIG. 22, the switch 178 at the left end of the carriage 166 is actuated, which then opens the solonoid valve 406, to allow the cylinder 187 to permit the clamping plate 192 to rise in engagement with the bottom surface of the longitudinally disposed conduit cover piece 120. The switch 178 also opens the solonoid valve 407 to allow air to actuate the cylinder 236, which is operative through the mechanical linkage 233 to actuate the clutch plate 224, to move the clutch plate leftward as viewed in FIG. 11, to contact the clutch facing 214, and thereby to transmit drive to the shaft 206, which is operative through the eccentric 205 to drive the punch plate 202 downwardly as viewed in either of FIGS. 11 or 22, for engagement of the piece 120 by the punching elements 212 and for punching of the tabs from the piece 120. As the carriage 166 continues its rightward movement as viewed in either of FIGS. 1 or 22, the right-most end of the carriage 166 strikes the switch 180, which thereby actuates the solonoid valve 405, to permit the air infeed to drive the piston of the cylinder 182 in a reverse direction, or leftward, as viewed in FIG. 22, for retraction of the carriage 166 toward the position illustrated in FIG. 22. It will be noted that the valve 407 is of the type which, when actuated, will permit the cylinder 236, to operate the clutch 224 for a given period of time, sufficient to permit the punch 204 to complete one cycle of motion, downward from its original upward position, and to return to its upward position, before discontinuing the supply of air to the cylinder 236. In the alternative, any other type of switching arrangement actuated by the punch plate 204, or otherwise (not shown) could be utilized to deactivate the solonoid valve 407 and to permit retraction of the punch plate 202 by the inertia of the moving plate 213 and to reset the cylinder 236, in a manner not shown.

With particular reference to the operation of the saw 356 and its longitudinally movable carriage 288, it will be noted that a motor 301 is connected to a suitable voltage source, such as an alternating current voltage source, and drives the hydraulic pump 302, to pump oil or similarly operable hydraulic fluid from the reservoir 303, through the solonoid valve 304, to feed the hydraulic motor 307, upon an uncut length of conduit 287 striking the switch 398, the switch 398 having been located at a location desirable for severing conduit 277 to selected lengths. With the actuation of the solonoid 304 by the switch 398, and the energization of the motor 307, the hydraulic motor 307 drives the carriage 288 rightward, as viewed in either of FIGS. 2 or 23. As the carriage 288 moves rightward, the switch 366 is actuated by the stop 335 carried by a stationary portion of the machine, and the switch 336 then opens the solonoid 410 to allow air to enter the cylinder 334 and drive the clamping plate 338 downwardly into engagement with the uncut conduit 277 to the moving carriage 288. Simultaneously with the opening of the solonoid 410, the switch 338 opens the solonoid 411 to allow air to drive the piston of the cylinder 342 downwardly, for pivoting the saw 356 through its downward ark. As the lever 347 holding the saw 356 begins its downward arcuate movement, the switch 366 is reset for actuation by the link 347 upon its return, and the saw 356 traverses through the work piece 277, cutting through the same transversely. As the saw 356 approaches its downward limit of arcuate movement, the link 347 actuates the switch 357 which in turn, reverses the setting of the solonoid 411, to cause the air being delivered to the cylinder 342 to drive the piston of the cylinder 342 leftward and upward, as viewed in FIG. 23, for lifting the saw 356 back to the position illustrated in FIG. 23. As the saw 356 approaches this latter position, the link 347 strikes the switch 366 which actuates the solonoid 410 to release the clamp 338, and also actuates the solonoid 304 to reverse the direction of pressurized fluid being supplied to the hydraulic motor 307, for reversing the direction of drive of the motor 307, and for reversing the direction of movement of the carriage 288, to a leftward movement, back to the position illustrated in FIG. 23. Also, as the switch 366 is actuated, it is operative through a suitable delay device 412, to permit, after sufficient time has passed for the carriage 288 to move leftward to clear the severed end of the conduit piece 277 that has just been cut, actuation of the solonoid valve 413, to permit air to fill the cylinders 381, for pivoting upward and leftward of the links 384, for ejection of a severed length of conduit in the manner described earlier. Upon completion of the ejection, the pistons of the cylinder 381 are returned by the springs 393 to their original retracted positions illustrated in FIG. 23.

As the carriage 288 returns to its position illustrated in FIG. 23, the left-most lower end thereof strikes the switch 309, which de-energizes the solonoid valve 304, the discontinue the drive being provided by the motor 307, with the carriage 288 in the position of FIG. 23, in the left-most stage of its back-and-forth motion, until the next serially delivered uncut section conduit 277 strikes the switch 398, for resuming the forward or rightward movement of the carriage 288 in the manner aforesaid.

As has been set forth above, it is the arcuate movement of the saw link 347 striking the switch 366 in its return movement that is operative to reverse the direction of drive for the carriage 288, through the motor 307. However, should for any reasons, the saw 356 not complete its sawing operation in sufficient time, either due to a worn saw blade 356 or the like and should the carriage 288 continue to move rightward without completion of the sawing operation, the carriage 288 would strike a safety switch 373, which would be operative to set the solonoid valve 304 in a neutral position, to discontinue driving the carriage 288, until the saw 356 has completed its sawing operation. Upon completion of the sawing operation, the link 347 would return in its normal course to strike the switch 366, which would complete the reversing of the direction of drive of the motor 307, by actuating the solonoid valve 304 from its neutral position to a position commensurate with leftward direction of drive of the carriage 288.

Description of Alternative Punching Apparatus

Referring now to FIGS. 24 through 28 in particular, it is seen that an alternative punching apparatus generally designated by the numeral 500 is provided, disposed upon the frame of the apparatus, as can be seen by reference to the horizontal support member 501. The member 501 may be identical with the member 37 illustrated in FIG. 1. Similarly, an edge bending station generally designated by the numeral 502 is carried by the member 501, with the edge bending station 502 being constructed to be substantially identical to the station 150 illustrated in FIG. 1, except for the presence of upper and lower switches 503 and 504 carried by suitable brackets 505 and 506, respectively.

Thus, the edge bending station 502 may comprise vertical supports 507 and 508, mounted on the horizontal support member 501 (and an opposite but like horizontal support member (unnumbered) parallel thereto), with the vertical support members 507, 508 together with the upper plate 510 providing ways 511. The ways 511 are used for adjustably positioning edge bending rollers and the like, in the same manner as exists in the edge bending station 150 of FIG. 1. Accordingly, a detailed discussion of such features will not be duplicated herein, it being sufficient that such is constructed to be virtually identical with that 150 illustrated in FIGS. 1 and 9.

The corrugated upper sheet in FIG. 24 is identified by the numeral 512, and proceeds in the direction of the arrow 513 through the punching apparatus 500.

Vertical supports such as 514, 515 are illustrated, in supporting relation to a horizontal support 516, that in turn supports the punch base 517. A vertically upstanding support member 518 is provided, having a neck portion that terminates in a horizontal supporting portion 520.

The base 517 supports a fixed plate 521 that in turn supports a fixed lower clamp plate 522.

An upper punch plate 523 is mounted for vertical movement relative to the fixed plate 521 in a generally conventional manner, by suitable guide rods 524, 525 fixedly carried by the plate 521, and vertically upwardly movable in bores of guide bosses such as 526 carried by the plate 523 for movement therewith.

The plate 523 carries an upper clamp member 530, on guides 531, for upward-and-downward sliding movement of the guides 531 in their bores within the plate 523, being spring-biased in a downward-most position of the clamp plate 530 relative to the plate 523 that carries it, due to the presence of helical compression springs 532.

Similarly, a plurality of guides (four in number spaced as illustrated in FIGS. 24 and 26) are provided, identified by the numeral 533, slidably movable within their bores in fixed plate 521, such that their heads 534 are upwardly and downwardly movable against the force of helical compression springs 535, as illustrated, with the heads 534 being adapted to engage the corrugated sheet 512 on its lower surface, for cushioning the seating of the sheet 512 on the fixed back-up plate 522, against the forces applied by the spring-biased hold-down 530, just prior to the actual punching of the sheet 512 by the punching elements 540 and 541.

The punching elements 540 and 541 are also carried by the upper plate 523, for movement therewith, and engage outer portions of the corrugated sheet 512, as illustrated in FIG. 25, just after the sheet 512 is clamped between the plates 530 and 522. It will be noted that the lower surface of the plate 530 is provided with simulated corrugations, as is the upper surface of the plate 522, for facilitating a precise aligned seating, without forward or rearward (relative to the direction of motion of the sheet 512 through the apparatus) movement of the sheet relative thereto, for precise aligned positioning of the punches relative to corrugations. Furthermore, it will be clear that, by such alignment, it is possible to assure that the punches 540 and 541 will always engage the sheet 512 in lands, rather than rises, of the corrugations.

The plate 523 is driven through yoke portions 545, 546 carried thereby, that in turn is driven through a shaft member 547, that in turn is driven upwardly and downwardly by suitable connecting rod 548. The connecting rod 548 has its upper end rotationally mounted on an eccentric 550 that in turn is carried for eccentric rotation with the rotatable shaft 551.

The shaft 551 has at its left-most end, a clutch plate 552, fixedly mounted with the shaft 551, for rotation therewith, and with the plate 552 being provided with a clutch facing 553.

Engagable with the clutch facing 553 of the plate 552 is a facing 554 of a clutch disc 555, that is rotationally driveable, but that is movable leftward and rightward as viewed in FIG. 26. Thus, the clutch disc 555 is movable toward and away from a back-up plate 556, and may be spring-biased leftward by suitable compression springs or the like (not shown), for retraction away from the plate 552, unless urged thereagainst by a shoe 557. If desired, the clutch disc and plate arrangement may not be spring-loaded, although it will most likely be desirable to load the same, for movement apart, for ease of discontinuance of the punching operation, upon activation of the shoe 557 away from the chamfered surface 558 of the clutch disc 555.

Accordingly, with the plate 555 being keyed for longitudinal movement relative to the shaft 560, but rotational therewith, the shaft 560 it can be seen, will be driven by a suitable pulley 561, that in turn is driven from a belt 562, that in turn is driven by another pulley 563 carried on a shaft 564 of a motor 565. The motor 565 is provided with a base plate 566 that in turn is welded to horizontal supports 567 and 568 that are L-shaped, and that in turn are welded or otherwise suitably carried by the upstanding member 518 as illustrated in FIG. 25.

The shoe 557 is actuated in a manner substantially identical to the activation of the shoe 230 in FIG. 12, such that, upon de-energization of the cylinder 570, a spring within the cylinder 570 will cause the cylinder rod 571 to move vertically upwardly, for activation of a generally horizontally disposed lever 572, that is connected across a pivot (not shown) to the shoe 557, such that vertical upward movement of the rod 571 will cause vertical downward movement of the shoe 557, for deactivation of the clutch 555, or for permitting the clutch 555 to cease transmission of rotational motion and energy to the plate 552.

Also with rotation of the shaft 551, when the clutch disc 555 is engaged with the clutch plate 552, the right-most portion 573 of the shaft 551 is rotatable, for rotation of a circular plate 574 that has an eccentric 575 carried thereby for eccentric rotation therewith, and with a crank rod 576 being pivotally mounted on the eccentric 575, for rotation relative thereto. The rod 576 is pivotally mounted at its upper end at 577, as illustrated in FIG. 25, to one end of a rod 578 that is mounted for pivotal movement on a shaft 580. It is thus seen, that as the right end of the shaft 573 rotates, when driven by activation of the clutch, the eccentric 575 will rotate eccentrically therewith, for driving the crank 576 such that its upper end moves the pin 577 upwardly and downwardly in a reciprocating motion.

Consequently, as the rod 576 drives the pin 577 upwardly, the rod 581 connected to the rod 578 by a pin 582 moves downwardly, and the converse, due to the reciprocating-motion linkage 577, 578, 581. The downward movement of the rod 581 drives a gear-tooth rack 583, also vertically downwardly, as illustrated by the arrow 584 in FIG. 27 in a controlled downward motion provided by a plurality of guide rollers 585, with teeth 586 of the rack 583 engaging complementally mating teeth 587 of a pinion gear 588, for rotation thereof in the clockwise direction of the arrow 590 illustrated in FIG. 27. A pair of dogs 591 pivotally mounted as at 592 on the pinion 588, for movement therewith, are spring-urged by suitable compression springs 593 into positive engagement within notches 594, such that the dogs 591 engage against drive surfaces 595, for movement of the ratchet plate 596 also in a clockwise direction, that in turn drives the shaft 597, securely keyed thereto also in a clockwise direction, with such motion also driving the corrugated-surfaced wheel 598 in the same direction (counter-clockwise as viewed in FIGS. 26), for advancing the corrugated sheet 512 rightward, as viewed in FIG. 26, or out of the plane of the paper as viewed in FIG. 25, in that the sheet 512 is securely gripped between the corrugated surface of the upper roller 598 and the lower roller 600. The lower roller 600 will be mounted as an idler, for rotation relative to the shaft 601, with the shaft 601 being fixedly mounted between vertical supports 602 and 603.

The shaft 597, will be mounted in suitable bearing blocks 604, 605 that are spring-urged downwardly by compression springs 606, in engagement thereagainst, and seated against members 607 carried by the vertical supports 602 and 603. This is for providing positive engagement by the wheel 598 against the sheet 512. IN this regard, it will be noted that the blocks 604 and 605 are slidable in suitable ways 610 that in turn are provided by vertical guide plates 611 and 612 for each block 604, and thus the shaft 597 is vertically movable, insofar as its left portion is concerned, as illustrated in FIG. 25. It will be understood that the right-most portion of the shaft 597 as illustrated in FIG. 25 is more fixedly mounted, with rotation therebetween (between the right and left portions) being provided by a generally flexible coupling 613. Also, the right-most end of the shaft is provided with an adjustable drag mechanism 614, as illustrated in FIG. 25, for controlling the resistance to rotation thereof by a shoe disposed within a split bearinng, by adjusting the member 615. The mechanism 614 may be a commercially available item if desired, for preventing free rotation of the shaft 597, for preventing over-running due to inertia and the like of the components carried by the shaft 597, that in turn might cause unnecessary and undesirable longitudinal motion of the sheet 512, that in turn might yield misalignment of punched holes.

It will be understood that the pinion gear 588 is not mounted for rotation with the shaft 597, but for rotation on a suitable bearing or sleeve or the like 617.

With reference to FIGS. 27 and 28, it will be apparent that the device operates as a ratchet. Thus, upon rotation of the shaft 573 such that the eccentric 575 begins its downward motion, whereupon the rod 581 begins its upward motion, such that the rack 583 is moved vertically upwardly, rotating the member 588 in a counter-clockwise direction as illustrated in FIG. 27, contrary to the direction of the arrow 590, the gear 588 moves relative to the plate 596, in that the plate 596 is fixed relative to the shaft 597, and the shaft 597 has sufficient frictional drag by virtue of the mechanism 614 that it will not also rotate, in that there is sufficient frictional resistance provided by the drag member 614 that the dogs 591 may slide along the surfaces 618, against the forces provided by compression springs 593, until the dogs 591 engage and slide along arcuate surface portions 620 of the member 596. The relationship and placement of notches 594 are disposed relative to each other, to correlate with the upward and downward movement of the rack 583, such that, upon dropping of the dogs 591 into next adjacent ones of the notches 594, the shaft 593 will be at a position that will then initiate downward motion of the rod 581. Thus, the ratchet arrangement of FIGS. 27 and 28 will be understood such that, for a portion of the rotation of the shaft 573, the rack 583 will drive downwardly, and in turn will drive the sheet 512 in a forward direction, and for another portion of the rotation of the shaft 573, the dogs 591 will slip along the surfaces 620, and the shaft 597 will be retained against counter-clockwise motion as viiewed in FIG. 27.

With particular reference to FIG. 30, the relative motions of various of the components will be more clearly understood. Various operations are illustrated relative to the rotation of the crank shaft 573. When the eccentric 575 is in a bottom dead-center position, it will be seen that the punch press has already been ascending for a short arcuate portion. This is to allow the punch elements 541, 540 to clear the rises of the corrugated sheet 512. At about the time that the eccentric 575 is in the bottom dead-center position illustrated in FIGS. 25 and 30 and the punch elements are clear of the sheet, the motion of the sheet is commenced as the eccentric 575 moves in an arcuate path in a counter-clockwise direction as viewed in FIGS. 25 and 30. The punch press has continued its upward movement, and continues so until it reaches its uppermost position and then commences its downward movement (see punch press full up in FIG. 30). The forward movement of the sheet, or indexing of the same continues until the eccentric 575 reaches a top dead-center position, in which the rack 583 is in its lower-most position. Then the rack immediately begins to move upwardly, and the shaft 597 remains still as the ratchet discussed above is operative so that the sheet will remain at rest until the punch press descends to its lower-most position. Just prior to the punch reaching its lower-most position, the elements 540 and 541 contact the sheet metal, perform their punching operation, and after completion of the punching operation, the punch press immediately commences its upward motion. It will thus be clear that in normal operation, the punch press continuously moves upwardly and downwardly, punching two tabs out of the corrugated sheet 512 withh each motion. The timing of the speed of the shaft 573 is correlated with the speed of the rest of the overall apparatus of this invention, specifically, for example the speed of delivery of sheet metal 512 thereto, and also to the station 502. The steady motion of the punch press upward and downward, will continue, because the motor 563 is continually running. The only interruption in the punching operation that may be effected will be that caused by clutch disengagement as discussed above. The clutch may be disengaged by the sheet 512 either becoming too loose, in which case it will strike the switch 504 indicated in FIG. 24, or becoming too tight, in which case it will assume the phantom line position illustrated in FIG. 24 and strike the switch 503.

Thus, if the loop of feed of the sheet 512 gets too small, the switch 503 will be struck, which will actuate a solenoid 650 as illustrated in FIG. 29, and direct the air delivered through the pneumatic system to exhaust as illustrated, rather than being provided for activation of the cylinder 570. Upon de-activation of the cylinder 570, as previously discussed, the clutch 555 will cease to activate the punching operation, by discontinuance of drive thereto. By discontinuing the operation of the punch, the operation (rotation) of the shaft 573 is also discontinued, and consequently the drive for the sheet 512 by the roller 598, through the rack and pinion arrangement 583, 588, is not effected, giving the delivery of the sheet from a location upstream, to the station 502 a chance to "catchup", whereupon the loop of the sheet 512 will enlarge, de-activating the switch 503, for reenergizing of the clutch 555, for continued punching as well as continued rotational driving through the rack-and-gear arrangement, and for longitudinal driving motion of the sheet 512 by means of the roller 598.

Similarly, if the loop in the sheet 512 gets too large, and approaches the phantom line position illustrated therefor in FIG. 24 such that it would strike the switch 504, the solenoid 650 will also be activated, to de-activate the cylinder 570, again for discontinuance of delivery of rotational drive to the shaft 573, at which point the punching operation will stop as aforesaid, as well as the longitudinally driving motion provided by the roller 598 and its operating mechanisms. This will allow the sheet to pass the then-deactivated drive roller 598, without awaiting driving thereof, and although such may allow a length of the sheet 512 to pass through the punch without having tab holes punched by the element, the operation of the machine need not be completely discontinued. It will be understood that in normal operation, it will not be necessary to de-activate the clutch, in that the loop 512 will range between acceptable limits, because the drive speed for the shaft 573 will be controlled by a constant speed motor 565 that has been pre-selected for correlating the speed of punching, as well as the drive for the sheet provided by the roller 598 with the speed of delivery of the sheet to the station 502, for example, such that the drive speed for the roller 598 is correlated with the drive speed of the sheet between the members 128 and 137. In fact, if desired, in lieu of the motor 563, the drive for the pulley 561 could be provided by the drive belt or chain 135, if desired, in which instance a clutching and declutching operation as discussed above for discontinuing the drive provided to the shaft 573 would be unnecessary.

It will be understood that, for the particular preferred embodiment of FIGS. 24 through 28 and 30, the schematic system of FIG. 29 replaces that of FIG. 22 for the previously discussed embodiment of the punching apparatus of this invention, but that, for the embodiment of the punching apparatus illustrated in FIGS. 24 through 28 and 30, the remainder of the apparatus of this invention as illustrated in the drawings remains substantially the same, as does the schematic drive system illustrated in FIG. 23.

A novel overall machine has been provided, along with a description of the method of achieving various other features of this invention, as well as a description of an article formed thereby. While various modifications may be made in the details of construction, as well as in the use and operation of the machine of this invention, and as well as in the techniques employed to construct conduit, and further in the details of construction of the conduit, it will be apparent that such modifications are within the spirit and scope of the invention as defined in the appended claims.

What is claimed is:

1. A machine for continuously making elongated conduit comprising means for continuously providing a first material piece and means for continuously providing a second material piece, both at the machine inlet, means for continuously discharging substantially straight, rigid conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining and fastening operation, wherein the means for making locking portions comprises means for punching out connected tabs from the first piece and wherein said continuous fastening means comprises means for bringing tabs punched from the first piece into edge engagement with opposite free edges of the second piece.

2. A machine for continuously making elongated conduit comprising means for continuously providing a first material piece and means for continuously providing a second material piece, both at the machine inlet, means for continuously discharging conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining and fastening operation, wherein the means for making locking portions comprises means for punching out connected tabs from the first piece and wherein said continuous fastening means comprises means for bringing tabs punched from the first piece into edge engagement with the second piece, wherein the punching means comprises longitudinally movable means for punching out the tabs while the first piece is in longitudinal motion.

3. A machine for continuously making elongated conduit comprising means for continuously providing a first material piece and means for continuously providing a second material piece, both at the machine inlet, means for continuously discharging conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining and fastening operation, wherein the means for making locking portions comprises means for punching out connected tabs from the first piece and wherein said continuous fastening means comprises means for bringing tabs punched from the first piece into edge engagement with the second piece, wherein the punching means comprises longitudinally stationary means for punching out the tabs while the localized portion of the first piece being punched is longitudinally stationary without interrupting the longitudinal motion of the first piece at locations upstream and downstream of said punching means.

4. A machine for continuously making elongated conduit comprising means for continuously providing a first material piece and means for continuously providing a second material piece, both at the machine inlet, means for continuously discharging conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining and fastening operation, wherein said means for forming the first piece includes means for continuously corrugating the first piece to have transverse corrugations having alternate rises and lands.

5. The machine of claim 4, wherein the means for making locking portions comprises means for punching out connected tabs from the first piece, wherein punching elements are provided with said punching means, and wherein means are provided for aligning the longitudinal positiion of the punching elements relative to the first piece to punch in lands only of the first piece.

6. The machine of claim 4, wherein said means for forming the first piece includes means for continuously bending edge portions of the first piece toward the second piece along longitudinal fold lines.

7. The machine of claim 3, including means upstream and downstream of said punching means, facilitating variations in slackness of feed and discharge of the first piece relative to said punching means.

8. The machine of claim 3, including localized incremental drive means for longitudinally conveying the first piece intermittently through said punching means.

9. The machine of claim 8, wherein said drive means is of the rack-and-pinion type, with said pinion being in connected relation to a rotatable follower of the first piece by a ratchet mechanism.

10. A machine for continuously making elongated conduit comprising means for continuously providing a first material piece and means for continuously providing a second material piece, both at the machine inlet, means for continuously discharging substantially straight, rigid conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining and fastening operation, wherein said means for forming the second piece includes a plurality of serially disposed roll means, with the roll means progressively varying in external configuration between a first and a last said roll means for progressively configuring the second conduit piece to have a desired configuration, wherein said roll means includes forming means for providing outwardly turned lips along opposite free edges of said second piece.

11. A machine for continuously making elongated conduit comprising means for continuously providing a first material piece and means for continuously providing a second material piece, both at the machine inlet, means for continuously discharging conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining and fastening operation, wherein the means for making locking portions comprises means for punching out connected tabs from the first piece and wherein said continuous fastening means comprises means for bringing tabs punched from the first piece into edge engagement with the second piece, including means mounted for disposition inside the joined conduit for internally engaging portions of the second piece thereof and urging edge portions of the second piece outwardly toward the tabs of the first piece.

12. The machine of claim 11, including roll means for effecting the edge engagement of first piece tabs and second piece edge by bending the tabs.

13. A machine for continuously making elongated conduit comprising means for continuously providing a first material piece and means for continuously providing a second material piece, both at the machine inlet, means for continuously discharging conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining ans fastening operation, including means for serially severing the conduit formed from the pieces into desired predetermined lengths while the conduit is continuously moving in its longitudinal direction, wherein said severing means comprises a carriage disposed for longitudinal movement parallel to the longitudinal path of conduit movement through the machine, with means for moving the carriage longitudinally, and with cutting means being carried by the carriage for cutting conduit transversely of its direction of movement.

14. The machine of claim 13, including clamping means carried by the carriage for clamping the conduit against movement relative to the carriage during the cutting by said cutting means.

15. The machine of claim 13, wherein said means for forming the first piece includes means for continuously corrugating the first piece to have transverse corrugations having alternate rises and lands, including means for aligning the longitudinal positiion of the carriage relative to the corrugated conduit first piece to transversely cut the conduit only through a land of the first piece thereof.

16. The machine of claim 15, wherein said aligning means comprises a rotatable follower carried by said carriage for engagement with corrugations of the conduit, and with said follower having portions adapted for interengagement with a member carried by said carriage when the carriage is moved longitudinally in the direction of travel of conduit, with said follower portions being disposed for effecting said interengagement only when said carriage is positioned relative to the conduit to cut in lands only of the conduit, and with said means for moving said carriage being operative to maintain said interengagement during movement of said carriage and the conduit together.

17. The machine of claim 13, including means responsive to the position of uncut conduit for actuating said carriage moving means.

18. The machine of claim 13, wherein said cutting means comprises a rotatable cutting blade adapted for transverse pivotal movement through the conduit.

19. The machine of claim 13, wherein said cutting means comprises a cutting element movable through the conduit for severing the conduit, and wherein means are provided, responsive to the movement of the cutting element for reversing the movement of the carriage upon completion of the severing.

20. The machine of claim 13, including means for ejecting severed lengths of conduit out of the paths of conduit travel, wherein said cutting means comprises a cutting element movable through the conduit for severing the conduit, and wherein means are provided, responsive to the movement of the cutting element for actuating said ejecting means.

21. A machine for continuously making elongated conduit comprising means for continuously providing a first material piece and means for continuously providing a second material piece, both at the machine inlet, means for continuously discharging conduit at the machine outlet, means for moving the pieces in paths of travel through the machine in a longitudinal direction, means for forming the first piece during its continuous movement, means for forming the second piece during its continuous movement, means for making locking portions from but integral with one of the pieces, and means for joining the pieces and fastening locking portions from the one of the pieces to the other of the pieces as a continuous joining and fastening operation, including means for serially severing the conduit formed from the pieces into desired predetermined lengths while the conduit is continuously moving in its longitudinal direction, including means for ejecting severed lengths of conduit out of the paths of conduit travel, wherein said ejecting means comprise pivotally movable members for engaging severed lengths of conduit and serially moving the severed lengths laterally of the longitudinal path of travel of the conduit.

22. A machine for making conduit comprising means for mounting rolls of conduit stock for unwinding, means defining paths of travel of stock being unwound into two separate paths for first and second stock pieces and a subsequent common path after joining of the first and second pieces, means for transversely corrugating a first piece during its movement along its path of travel, means for punching integrally connected tabs from the first piece along its path of travel, means comprising forming rolls for progressively forming the second stock piece to have a desired cross-sectional configuration, means for joining the first and second pieces and for fastening the punched tabs of the first piece with edges of the second piece, and means for cutting the conduit formed by joining the pieces, to selected lengths, by passing a cutting element through the conduit, with the cutting element being carried by a carriage movable back-and-forth along the path of travel of the moving conduit.

23. A device for joining and fastening together two sheets of material as part of a continuous operation for making conduit from the two sheets comprising means for continuously providing two moving formed sheets with one of the sheets comprising an elongated conduit cover having integrally connected tabs along edges thereof and the other of the sheets comprising an elongated trough having outwardly turned edges, means for urging the cover and trough into contact with their respective edges in engagement, means for urging portions of the trough into engagement with the tabs from inside the trough after the cover has been disposed thereon, and means for bending tabs of the cover into fastening engagement with the portions of the trough from outside the trough.

24. A method of continuously making elongated conduit from an elongated cover sheet and an elongated trough sheet comprising the steps of continuously supplying a continuous elongated cover sheet and a continuous elongated trough sheet, moving the sheets longitudinally along predetermined paths, punching tabs out of one of the sheets and leaving the tabs integrally connected to the one sheet, progressively forming the trough sheet to have a desired trough configuration, joining the sheets, and securing the tabs of the one sheet to portions of the other sheet and continuously delivering conduit formed of the two sheets, wherein the tabs are punched from the cover sheet, and are secured during the securing step to the edges of the trough sheet.

25. A method of continuously making elongated conduit from an elongated cover sheet and an elongated trough sheet comprising the steps of continuously supplying a continuous elongated cover sheet and a continuous elongated trough sheet, moving the sheets longitudinally along predetermined paths, punching tabs out of one of the sheets and leaving the tabs integrally connected to the one sheet, progressively forming the trough sheet to have a desired trough configuration, joining the sheets, and securing the tabs of the one sheet to portions of the other sheet and continuously delivering conduit formed of the two sheets, wherein the punching operation comprises locally stopping the otherwise continuous motion of the sheet to be punched, in the vicinity of a punching station, punching the tabs at the punching station and then resuming the motion of the sheet being punched, all as a continuously repetitive motion.

26. The method of claim 24, including the step of transversely severing the conduit formed by joining the sheets during its longitudinal movement, to selected conduit lengths.

27. The method of claim 26, including the step of serially ejecting the lengths of conduit from the path of conduit travel.

28. The method of claim 24, wherein the progressive forming, joining and securing steps are done during longitudinal movement of the associated sheet portions being formed, joined and secured.

29. A machine for continuously making elongated conduit comprising means for continuously providing a first material piece, means for continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to the other of the pieces, all as a continuous operation, wherein the means for forming locking portions comprises means for punching out connected tabs from the first piece and wherein said fastening means comprises means for bringing tabs punched from the first piece into edge engagement with free outwardly bent edges of the second piece.

30. A machine for continuously making elongated conduit comprising means for continuously providing a first material piece, means for continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to the other of the pieces, all as a continuous operation, wherein said means for forming the first piece includes means for continuously corrugating the first piece to have transverse corrugations having alternate rises and lands, wherein the means for forming locking portions comprises means for punching out connected tabs from the first piece, wherein punching elements are provided with said punching means, and wherein means are provided for aligning the longitudinal position of the punching elements relative to the first piece to punch in lands only of the first piece.

31. A machine for continuously making elongated conduit comprising means for continuously providing a first material piece, means for continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to the other of the pieces, all as a continuous operation, wherein said means for forming locking portions comprises a carriage longitudinally movable along the path of travel of the first piece, and having means for moving said carriage parallel to the path of movement of the first piece, with tab punching means carried by said carriage for punching out tabs from the first piece.

32. The machine of claim 31, including clamping means carried by said carriage for clamping the first pieces relative to the punching means prior to the tab punching.

33. The machine of claim 30, wherein said punching means are carried by a carriage longitudinally movable along the path of travel of the first piece, and having means for moving said carriage parallel to the path of movement of the first piece, said aligning means comprising a rotatable member carried by said carriage and having a toothed portion in toothed engagement with the corrugations of the first piece and being rotatably driveable upon relative movement between said carriage and the first piece, said rotatable member having a portion adapted to engage a mating member carried by said carriage, said rotatable member portion and said mating member being disposed for interengagement only when said punching elements are aligned with the lands of the corrugated first piece, and means for permitting actuation of said punching elements only when said interengagement is effected.

34. The machine of claim 31, wherein said means for moving said carriage includes means for moving the carriage in the direction of movement of the first piece and for reversing such direction and moving the carriage in the reverse direction, in a back-and-forth motion.

35. A machine for continuously making elongated conduit comprising means for continuously providing a first material piece, means for continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to outer edges of the other of the pieces, all as a continuous operation, wherein said means for forming the second piece includes means for progressively arcuately configuring the second piece in cross-section.

36. A machine for continuously making elongated conduit comprising means for continuously providing a first material piece, means for continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to outer edges of the other of the pieces, all as a continuous operation, wherein said means for forming the second piece includes a plurality of serially disposed roll means, with the roll means progressively varying in external configuration between a first and a last said roll means for progressively configuring the second conduit portion to have a desired configuration.

37. The machine of claim 36, wherein said means for forming the second piece includes a plurality of serially disposed roll means, with the roll means progressively varying in external configuration between a first and a last said roll means for progressively configuring the second conduit portion to have a desired configuration.

38. A machine for continuously making elongated conduit comprising means for continuously providing a first material piece, means for continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to the other of the pieces, all as a continuous operation, wherein the means for forming locking portions comprises means for punching out connected tabs from the first piece and wherein said fastening means comprises means for bringing tabs punched from the first piece into edge engagement with the second piece, including means mounted for disposition inside the joined conduit for internally engaging portions of the second piece thereof and urging edge portions of the second piece outwardly toward the tabs of the first piece.

39. A machine for continuously making elongated conduit comprising means for continuously providing a first material piece, means for continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to the other of the pieces, all as a continuous operation, including means for severing the conduit formed from the pieces into desired predetermined lengths, as a part of the continuous operation, wherein said severing means comprises a carriage disposed for longitudinal movement parallel to the longitudinal path of conduit movement through the machine, with means for moving the carriage longitudinally, and with cutting means being carried by the carriage for cutting conduit transversely of its direction of movement.

40. The machine of claim 39, including clamping means carried by the carriage for clamping the conduit against movement relative to the carriage during the cutting by said cutting means.

41. The machine of claim 39, wherein said means for forming the first piece includes means for continuously corrugating the first piece to have transverse corrugations having alternate rises and lands, including means for aligning the longitudinal position of the carriage relative to the corrugated conduit first piece to transversely cut the conduit only through a land of the first piece thereof.

42. The machine of claim 41, wherein said aligning means comprises a rotatable follower carried by said carriage for engagement with corrugations of the conduit, and with said follower having portions adapted for interengagement with a member carried by said carriage when the carriage is moved longitudinally in the direction of travel of conduit, with said follower portions being disposed for effecting said interengagement only when said carriage is positioned relative to the conduit to cut in lands only of the conduit, and with said means for moving said carriage being operative to maintain said interengagement during movement of said carriage and the conduit together.

43. The machine of claim 39, including means responsive to the position of uncut conduit for actuating said carriage moving means.

44. The machine of claim 39, wherein said cutting means comprises a rotatable cutting blade adapted for transverse pivotal movement through the conduit.

45. The machine of claim 39, wherein said cutting means comprises a cutting element movable through the conduit for severing the conduit, and wherein means are provided, responsive to the movement of the cutting element for reversing the movement of the carriage upon completion of the severing.

46. The machine of claim 39, including means for ejecting severed lengths of conduit out of the paths of conduit travel, wherein said cutting means comprises a cutting element movable through the conduit for severing the conduit, and wherein means are provided, responsive to the movement of the cutting element for actuating said ejecting means.

47. A machine for continuously making elongated conduit comprising means for continuously providing a first material piece, means fo continuously providing a second material piece, means for continuously moving the pieces in paths of travel through the machine in a longitudinal direction, means for forming the first piece during its continuous movement, means for forming the second piece during its continuous movement, means for forming locking portions from but integral with one of the pieces, and means for joining the pieces and fastening locking portions from the one of the pieces to the other of the pieces, all as a continuous operation, including means for severing the conduit formed from the pieces into desired predetermined lengths, as part of the continuous operation, including means for ejecting severed lengths of conduit out of the paths of conduit travel, wherein said ejecting means comprise pivotally movable members for engaging severed lengths of conduit and serially moving the severed lengths laterally of the longitudinal path of travel of the conduit.

48. A machine for making conduit comprising means for mounting rolls of conduit stock for unwinding, means defining paths of travel of stock being unwound into two separate paths for first and second stock pieces and a subsequent common path after joining of the first and second pieces, means for transversely corrugating a first piece during its movement along its path of travel, means for punching integrally connected tabs from the first piece along its path of travel, said latter means comprising a carriage movable back-and-forth along the path of travel of the first piece and having punching elements carried thereby, means comprising forming rolls for progressively forming the second stock piece to have a desired cross-sectional configuration, means for joining the first and second pieces and for fastening the punched tabs of the first piece with edges of the second piece, and means for cutting the conduit formed by joining the pieces, to selected lengths, by passing a cutting element through the conduit, with the cutting element being carried by a carriage movable back-and-forth along the path of travel of the conduit.

49. A method of continuously making elongated conduit from an elongated cover sheet and an elongated trough sheet comprising the steps of continuously longitudinally moving elongated sheets along predetermined paths, punching tabs out of one of the sheets during its movement and leaving the tabs integrally connected to the one sheet, continuously progressively forming the trough sheet to have a desired trough configuration, joining the sheets, and securing the tabs of the one sheet to portions of the other sheets, wherein the tabs are punched from the cover sheet and are secured during the securing step to the edges of the trough sheet.

50. A method of continuously making elongated conduit from an elongated cover sheet and an elongated trough sheet comprising the steps of continuously longitudinally moving elongated sheets along predetermined paths, punching tabs out of one of the sheets during its movement and leaving the tabs integrally connected to the one sheet, continuously progressively forming the trough sheet to have a desired trough configuration, joining the sheets, and securing the tabs of the one sheet to portions of the other sheets, including the step of continuously corrugating the cover sheet.

51. A method of continuously making elongated conduit from an elongated cover sheet and an elongated trough sheet comprising the steps of continuously supplying a continuous elongated cover sheet and a continuous elongated trough sheet, moving the sheets longitudinally along predetermined paths, punching tabs out of one of the sheets and leaving the tabs integrally connected to the one sheet, progressively forming the trough sheet to have a desired trough configuration, joining the sheets, and securing the tabs of the one sheet to portions of the other sheet and continuously delivering conduit formed of the two sheets, including the step of continuously corrugating the cover sheet.

52. The machine of claim 37, wherein the means for forming locking portions comprises means for punching out connected tabs from the firist piece and wherein said fastening means comprises means for bringing tabs punched from the first piece into edge engagement with the second piece, including roll means for engaging outer portions of the formed second piece and urging edge portions of the second piece inwardly within the elastic bending limit of the second piece for subsequent outward movement of the edge portions of the second piece into engagement with the tabs of the first piece.

* * * * *